US009371744B2

(12) United States Patent
Gouko et al.

(10) Patent No.: US 9,371,744 B2
(45) Date of Patent: Jun. 21, 2016

(54) HEAT ENGINE

(75) Inventors: Norio Gouko, Nagoya (JP); Masahiro Asano, Anjo (JP); Atusi Sakaida, Nagoya (JP); Tomikazu Ishikawa, Kariya (JP); Keiji Okamoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 1363 days.

(21) Appl. No.: 12/897,233

(22) Filed: Oct. 4, 2010

(65) Prior Publication Data

US 2011/0079007 A1 Apr. 7, 2011

(30) Foreign Application Priority Data

Oct. 5, 2009 (JP) ..... 2009-231419
Jun. 25, 2010 (JP) ..... 2010-145016
Jun. 25, 2010 (JP) ..... 2010-145017
Jun. 25, 2010 (JP) ..... 2010-145018

(51) Int. Cl.
*F03C 1/00* (2006.01)
*F01K 11/00* (2006.01)

(52) U.S. Cl.
CPC ..... *F01K 11/00* (2013.01)

(58) Field of Classification Search
CPC ..... F01K 11/00; F25B 2321/02; F25B 2321/025; F25B 2321/0212; F25B 2321/0252
USPC ..... 60/531, 641.8–641.15, 670
See application file for complete search history.

(56) References Cited

U.S. PATENT DOCUMENTS 3,670,495 A 6/1972 Leffert
6,073,449 A * 6/2000 Watanabe et al. ..... 62/3.2
7,775,261 B2 * 8/2010 Valenzuela ..... 165/104.26
9,103,232 B1 * 8/2015 Hall ..... F28B 1/00
2003/0106671 A1 6/2003 Cho et al.

FOREIGN PATENT DOCUMENTS

JP A-62-038809 2/1987
JP A-08-338207 12/1996

(Continued)

OTHER PUBLICATIONS

Office Action issued in Japanese Patent Application No. 2010-145016 dated Sep. 22, 2011 (with translation).

(Continued)

*Primary Examiner* — Audrey K Bradley
*Assistant Examiner* — Jason Sheppard
(74) *Attorney, Agent, or Firm* — Oliff PLC

(57) ABSTRACT

A heat engine is provided which includes: a boiler unit including an evaporation chamber and a fluid-pool chamber, the evaporation chamber heating a working fluid by supplied heat and generating vapor of the fluid, and the fluid-pool chamber collecting the fluid supplied to the evaporation chamber; an output unit through which the vapor flows, and which converts energy of the vapor to mechanical energy; a condensation unit which condenses the vapor that has passed through the output unit, and refluxes the condensed fluid to the fluid-pool chamber; and a working fluid guide member which is disposed in the boiler unit, and which sucks the fluid in the fluid-pool chamber by using capillary force and supplies the fluid to the evaporation chamber. The evaporation chamber is separated from the fluid-pool chamber. Pressure in the evaporation chamber is higher than pressure in the fluid-pool chamber. The working fluid guide member satisfies $(2\sigma/r)\cdot\cos\theta > PH - PL$.

17 Claims, 19 Drawing Sheets

(56) References Cited

FOREIGN PATENT DOCUMENTS

| | | |
|---|---|---|
| JP | A-09-186279 | 7/1997 |
| JP | A-2003-042670 | 2/2003 |
| JP | A-2005-518518 | 6/2005 |
| JP | A-2007-095762 | 4/2007 |
| JP | A-2008-153423 | 7/2008 |
| JP | A-2008-267743 | 11/2008 |
| WO | WO 03/073032 A1 | 9/2003 |

OTHER PUBLICATIONS

Office Action issued in Japanese Patent Application No. 2010-145018 dated Sep. 22, 2011 (with translation).

* cited by examiner

HEAT ENGINE

CROSS-REFERENCE TO RELATED APPLICATION

This application is based on and claims the benefit of priorities from earlier Japanese Patent Application Nos. 2009-231419, 2010-145018, 2010-145017 and 2010-145016 filed Oct. 5, 2009, Jun. 25, 2010, Jun. 25, 2010 and Jun. 25, 2010, respectively, the descriptions of which are incorporated herein by reference.

BACKGROUND OF THE INVENTION

1. Technical Field of the Invention

The present invention relates to a heat engine which heats and evaporates a working fluid, takes out energy from the vapor resulting from the evaporation in the form of mechanical energy, and then condenses the vapor for circulation, and which can be favorably used for an exhaust heat recovery apparatus.

2. Related Art

This type of heat engines, in general, use such an apparatus as a pump as disclosed in JP-A-H08-338207, for example. Specifically, in such a heat engine, an evaporation unit for evaporating a working fluid has a high pressure, while a condensation unit for condensing vapor (for restoring the working fluid) has a low pressure. The pump is used for circulating the working fluid condensed in the condensation unit into the evaporation unit. More specifically, such an apparatus as a pump is actuated using external energy, for pressurization of the working fluid in the condensation unit and for circulation of the pressurized working fluid into the evaporation unit.

As mentioned above, heat engines of the conventional art are configured to use such a mechanism as a pump to circulate a working fluid condensed in a condensation unit into an evaporation unit. Therefore, besides the external energy (heat energy) for heating and evaporating the working fluid, additional external energy is necessary for actuating the mechanism, such as a pump. Thus, the necessity of additional external energy unavoidably puts a limitation on the improvement of the output efficiency.

SUMMARY

An embodiment provides a heat engine which can circulate a working fluid condensed in a condensation unit into an evaporation unit having a high pressure, without using external energy as much as possible.

As one aspect of the embodiment, the heat engine includes: a boiler unit which includes an evaporation chamber and a fluid-pool chamber, the evaporation chamber heating a working fluid by heat supplied from an external heat source and generating vapor of the working fluid, and the fluid-pool chamber collecting the working fluid supplied to the evaporation chamber; an output unit through which the vapor generated by the evaporation chamber flows, and which converts energy of the vapor to mechanical energy; a condensation unit which condenses the vapor that has passed through the output unit, and refluxes the condensed working fluid to the fluid-pool chamber; and a working fluid guide member which is disposed in the boiler unit, and which sucks the working fluid in the fluid-pool chamber by using capillary force and supplies the working fluid to the evaporation chamber, wherein the evaporation chamber is separated from the fluid-pool chamber, pressure in the evaporation chamber being higher than pressure in the fluid-pool chamber, and the working fluid guide member is configured to satisfy the following expression: $(2\sigma/r)\cdot\cos\theta > PH - PL$ where $\sigma$ is a surface tension of the working fluid, r is a circle-equivalent radius of a void in the working fluid guide member, $\theta$ is a wetting angle of the working fluid with respect to the working fluid so guide member, PH is pressure in the evaporation chamber, and PL is pressure in the fluid-pool chamber.

DETAILED DESCRIPTION OF THE PREFERRED EMBODIMENTS

Figure 1:
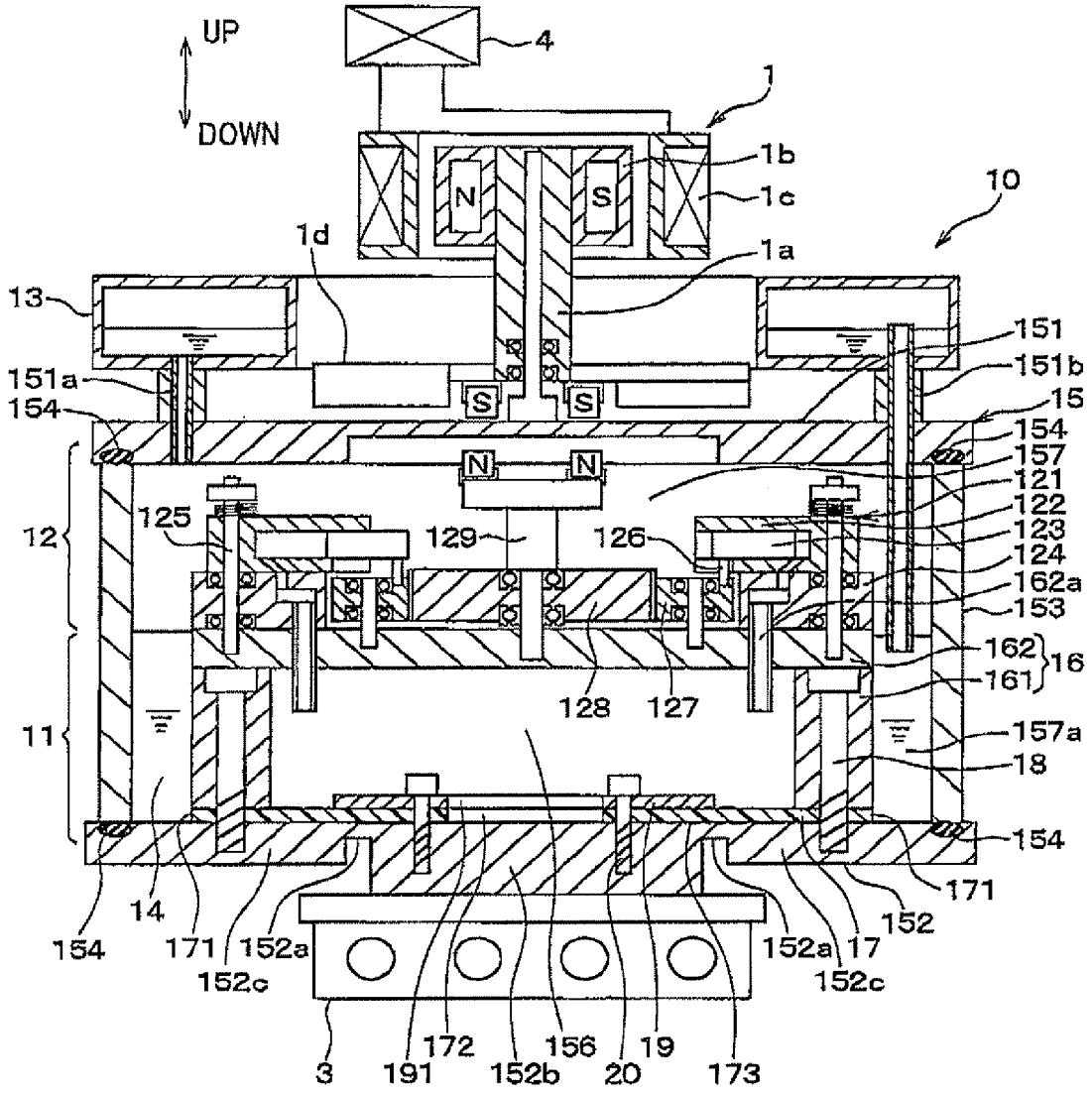
FIG. 1 is a cross-sectional view illustrating an exhaust heat recovery apparatus.

With reference to FIGS. 1 to 21, hereinafter are described several embodiments of the present invention. Throughout the embodiments, the identical or similar components are given the same reference numerals for the sake of omitting explanation.

(First Embodiment)

Figure 2:
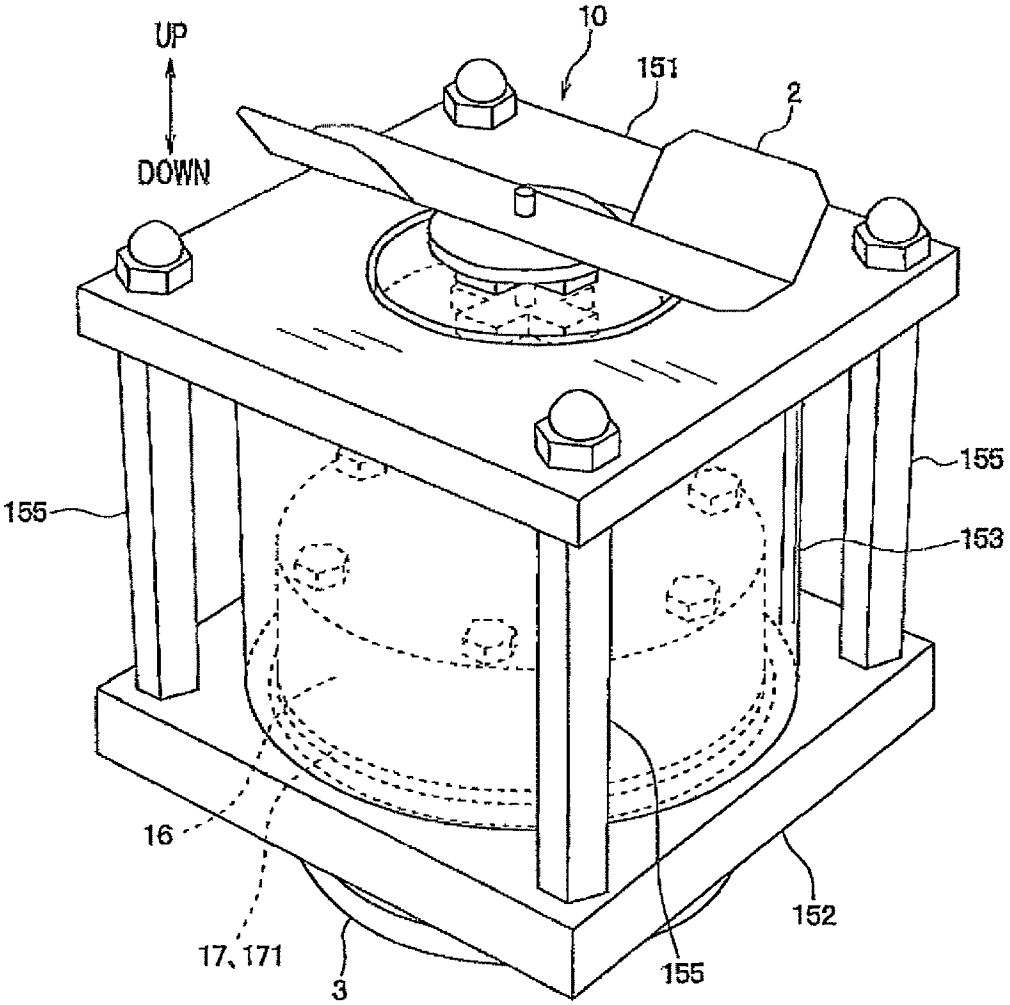
FIG. 2 is a perspective view illustrating an appearance of the exhaust heat recovery apparatus.
Figure 3:
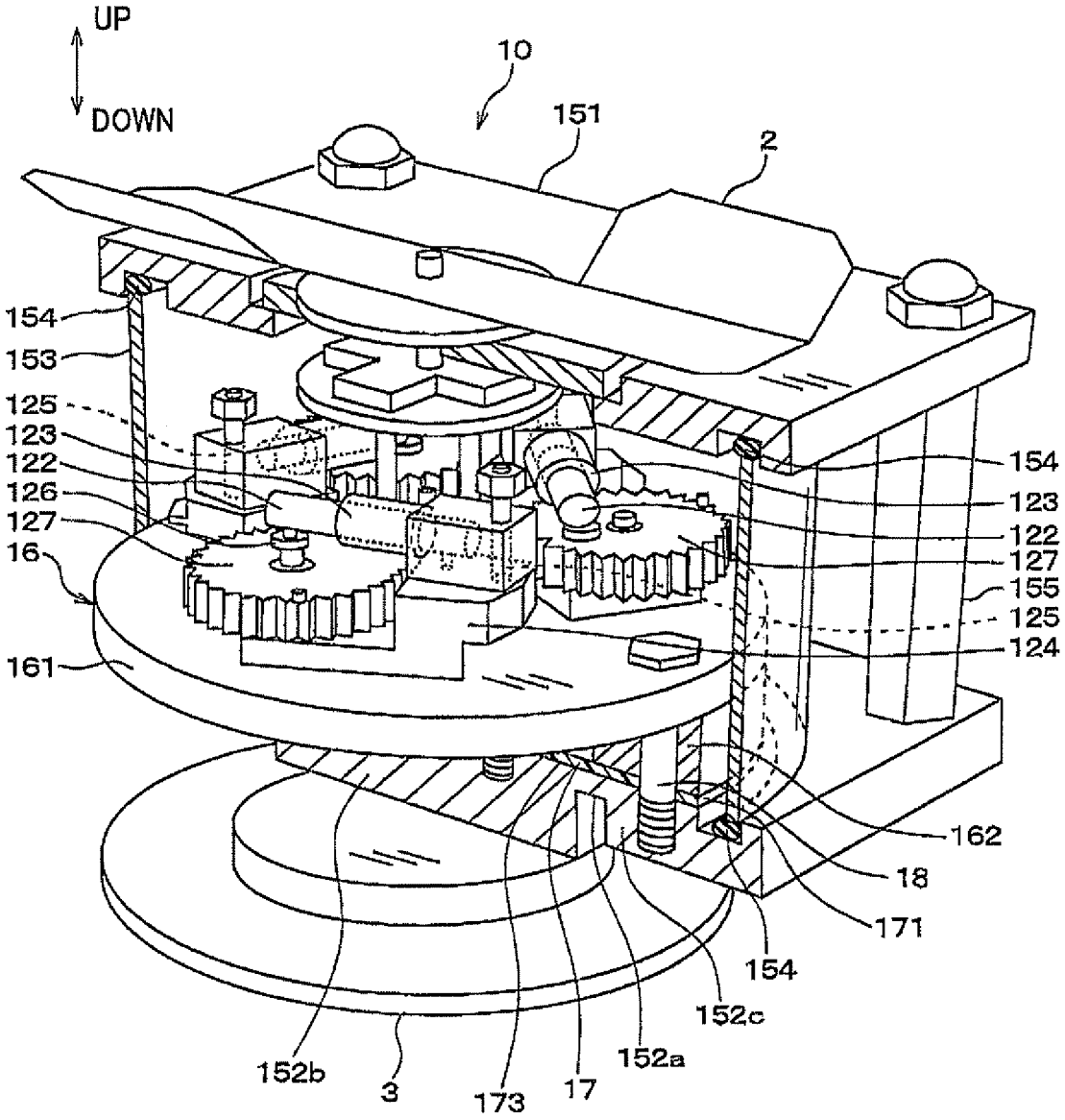
FIG. 3 is a perspective view illustrating an inner structure of the exhaust heat recovery apparatus.

In the present embodiment, a heat engine is applied to an exhaust heat recovery apparatus. FIG. 1 is a cross-sectional view illustrating a general configuration of the exhaust heat recovery apparatus. FIG. 2 is a perspective view illustrating an appearance of the exhaust heat recovery apparatus. FIG. 3 is a perspective view illustrating an inner structure of the exhaust heat recovery apparatus. In FIGS. 1 to 4C, the upward and downward arrows indicate the vertical direction (top-bottom direction) of the exhaust heat recovery apparatus in a state of being installed.

An exhaust heat recovery apparatus 10 of the present embodiment is roughly divided into a boiler unit 11, an output unit 12 and a condensation unit 13. As shown in FIG. 1, mechanical energy taken out in the exhaust heat recovery apparatus 10 is used for electric generation, and thus a generator 1 is attached to the exhaust heat recovery apparatus 10. As shown in FIG. 2, mechanical energy taken out by the exhaust heat recovery apparatus 10 is used for rotating and actuating a fan 2.

The boiler unit 11 uses heat (exhaust heat) supplied from an external heat source to heat and evaporate a working fluid 14 (water in the present embodiment), so that the vapor of the working fluid 14 can be supplied to the output unit 12. The output unit 12 converts the energy of the vapor supplied from the boiler unit 11 into mechanical energy and outputs the converted mechanical energy.

The condensation unit 13 condenses the vapor that has passed through the output unit 12 for restoration to the working fluid 14. Then, the condensation unit 13 refluxes the restored working fluid 14 to the boiler unit 11. Thus, the condensation unit 13 may also be referred to as a reflux unit.

The boiler unit 11 and the output unit 12 are accommodated in a case 15. In the present embodiment, the case 15 is formed of a single vessel. The case 15 is mounted on a heating unit 3 that constitutes an external heat source. In the present embodiment, the heating unit 3 is adapted to generate heat using exhaust heat emitted from a factory.

The case 15 have wall portions forming its housing, the wall portions being configured by two plates 151, 152 extending in the horizontal direction and a cylinder 153 extending in the vertical direction between the two plates 151, 152. Specifically, vertical wall portions of the case 15 are formed of the plates 151, 152, while a side wall portion of the case 15 is formed of the cylinder 153.

In the present embodiment, since water is used as the working fluid 14, it is favorable that the plates 151, 152 and the cylinder 153 are formed of stainless steel having good water resistance. Also, in the present embodiment, the plates 151, 152 each have a flat rectangular plate-like shape and the cylinder 153 has a cylindrical shape.

The plates 151, 152 and the cylinder 153 are fixed to each other to ensure fluid tightness and air tightness. As shown in FIG. 1, a sealing member 154 is interposed between the plate 151 and the cylinder 153 and between the plate 152 and the cylinder 153. As shown in FIGS. 2 and 3, pillars 155 are arranged on the outer peripheral side of the cylinder 153 to establish connection between the plates 151 and 152.

In the inner space of the case 15, a high-pressure chamber 156 and a low-pressure chamber 157 are defined by a bulkhead 16. The bulkhead 16 is divided into a cylindrical wall portion 161 which is disposed on the lower wall portion 152 of the case 15 and a plate-like wall portion 162 overlaid on the cylindrical wall portion 161. In the present embodiment, the cylindrical wall portion 161 has a cylindrical shape and the plate-like wall portion 162 has a disc-like shape.

The high-pressure chamber 156 forms a space defined by the inner surface of the cylindrical wall portion 151 and the lower surface of the plate-like wall portion 162. The high-pressure chamber 156 serves as an evaporation chamber in which the working fluid 14 is heated and evaporated by the heat of the heating unit 3. Thus, the pressure in the high-pressure chamber 156 will become high with the vapor of the working fluid 14.

The low-pressure chamber 157 forms a space defined by the outer surface of the cylindrical wall portion 161 and the upper surface of the plate-like wall portion 162. The vapor that has flowed through the output unit 12 and the working fluid 14 condensed by the condensation unit 13 flows into the low-pressure chamber 157. Thus, the pressure in the low-pressure chamber 157 is lower than the pressure in the high-pressure chamber 156.

The bulkhead 16 is formed of a heat-insulating material having heat resistance, such as a heat-resistant resin, so that the vapor in the evaporation chamber (high-pressure chamber) will not be cooled and condensed.

An engine 121 that configures the output unit 12 is disposed in so the low-pressure chamber 157. In the present embodiment, the engine 121 is fixed to the upper surface of the plate-like wall portion 162 of the bulkhead 16, with a vapor path 162*a* being formed in the plate-like wall portion 162, for the supply of the vapor in the evaporation chamber 156 to the engine 121.

In the low-pressure chamber 157, there is a space between the cylinder 153 of the case 15 and the cylindrical wall portion 161 of the bulkhead 16. This space serves as a fluid-pool chamber 157*a* that collects the working fluid 14 supplied to the evaporation chamber 156. Specifically, the fluid-pool chamber 157*a* is horizontally juxtaposed with the evaporation chamber 156.

A wick 17 is interposed between the bottom wall portion (lower wall portion) 152 of the case 15 and the cylindrical wall portion 161 of the bulkhead 16. The wick 17 serves as a working fluid guide member.

The "working fluid guide member" here refers to a member that generates capillary force for sucking the working fluid 14 in the fluid-pool chamber 157 (capillary force generating member). Specifically, the working fluid guide member refers to a porous body, such as a porous ceramic or a sintered metal body, or a structure interwoven with fibers.

In the present embodiment, the wick 17 is formed of a sheet-like material having heat resistance. Specifically, the wick 17 is formed of a material interwoven with stainless steel wires and aramid fibers (thermoplastic resin fibers). In the present embodiment, the wick 17 is formed into a plate-like shape, or more specifically, into a disc-like shape.

The wick 17 is mounted on the bottom wall portion 152 having a flat shape. Specifically, the wick 17 overlaps with the upper surface portion of the bottom wall portion 152 which extends in the horizontal direction. The bottom wall portion 152 is thermally connected with the heating unit 3 (the bottom wall portion 152 is contact with the heating unit 3), thereby acting as a heat-transfer member transferring heat from the heating unit 3 to the wick 17. Thus, a lower surface portion (fiat portion on the side of the bottom wall portion 152) 173 of the wick 17 receives heat from the heating unit 3 via the bottom wall portion 152.

The wick 17 has an outer peripheral edge portion sandwiched between the bottom wall portion 152 of the case 15 and the cylindrical wall portion 161 of the bulkhead 16. Resultantly, of the wick 17, an end surface 171 in the horizontal direction configures an inlet through which the working fluid 14 flows from the fluid-pool chamber 157.

The center portion (center-side portion with reference to the cylindrical wall portion 161) of the wick 17 is located within the evaporation chamber 156. In other words, the wick 17 extends into the evaporation chamber 156 from beneath the cylindrical wall portion 161.

In the present embodiment, the cylindrical wall portion 161 and the wick 17 are tightened up together by bolts 18 for fixation to the bottom wall portion 152 of the case 15. With the tightening of the bolts 18, the wick 17 is held in the case 15, in the state of being loaded and compressed by the cylindrical wall portion 161.

With the wick 17 being loaded and compressed by the cylindrical wall portion 161, voids in the wick 17 are reduced in size compared to the state where the wick 17 is not being loaded (unitary state of the wick 17). In other words, the cylindrical wall portion 161 constitutes a loading means that imposes load on the wick 17 so that the voids in the wick 17 will be reduced in size.

Thus, a pressure difference is caused in the wick 17 due to the capillary action. The pressure difference caused by the capillary action is hereinafter referred to as a "pressure ΔP of the capillary force of the wick 17". The pressure ΔP of the capillary force of the wick 17 can be expressed by the following Expression (1):

$$\Delta P=(2\sigma/r)\cdot\cos\theta \quad (1)$$

where r is a circle-equivalent radius (capillary radius) of the voids in the wick 17, σ is a surface tension and θ is a wetting angle. The term "circle-equivalent radius" refers to a radius of a circle whose area is equal to the cross section of an object.

As described above, the wick 17 is loaded and compressed by the cylindrical wall portion 161 to reduce the size of the voids in the wick 17. Thus, the circle-equivalent radius r of each void in the wick 17 expressed in Expression (1) is made small. Thus, when the pressure in the high-pressure chamber 156 is expressed by PH and the pressure in the low-pressure chamber 157 is expressed by PL, the pressure ΔP of the capillary force of the wick 17 is ensured to be larger than the pressure difference (PH−PL) between the high-pressure chamber 156 and the low-pressure chamber 157 (ΔP>PH−PL).

In other words, the wick 17 is configured to satisfy the relation as expressed by the following Expression (2):

$$(2\sigma/r)\cdot\cos\theta>PH-PL \quad (2)$$

The wick 17 has a center portion on which a disc-like plate 19 is placed. The plate 19 and the wick 17 are tightened up together by bolts 20 for fixation to the bottom wall portion 152 of the case 15 to prevent uplift of the center portion of the wick 17.

Of the wick 17 and the plate 19, those portions which are located within the evaporation chamber 156 are formed with a predetermined number of through holes 172, 191, respectively, each having a predetermined shape and extending in the vertical direction. The through holes 172 and 191 pass through the wick 17 and the plate 19, respectively, from the front surfaces to the rear surfaces thereof. The through holes 172, 191 play a role of vapor vent ports through which the vapor generated in the evaporation chamber 156 can escape to the upper side of the wick 17 and the plate 19.

In other words, the working fluid 14 in the evaporation chamber 156, when evaporated by the heat conduction from the bottom wall portion 152 of the case 15, is vented to the upper side of the wick 17 and the plate 19 via the through holes 172, 191.

The bottom wall portion 152 has a circular heat insulating groove 152*a*. Specifically, the heat insulating groove 152*a* is formed at a portion of the bottom wall portion 152, which portion is on the side of the fluid-pool chamber 157*a* with reference to the through holes 172, 191, to suppress heat transfer in the bottom wall portion 152.

A portion of the bottom wall portion 152 is mounted on the heating unit 3 and in contact with the heating unit 3. This portion of the bottom wall portion 152 corresponds to an inner portion 152*b* which is located inner side of the heat insulating groove 152*a*, i.e. a portion located on the side of the through holes 172, 191 with reference to the heat insulating groove 152*a*. Meanwhile, an outer portion 152*c* which is located outer side of the heat insulating groove 152*a* of the bottom wall portion 152 is not mounted on the heating unit 3 and thus is not in contact with the heating unit 3.

The cylindrical wall portion 161 of the bulkhead 16 is disposed on the outer portion 152*c* which is located on the outer side of the heat insulating groove 152*a* of the bottom wall portion 152.

In the present embodiment, a pendulum-type engine is used as the engine 121 of the output unit 12. In the pendulum-type engine, pistons 122 and cylinders 123 sway like pendulums. As an alternative to the engine 121, a steam turbine or the like may be used.

Figure 4B:
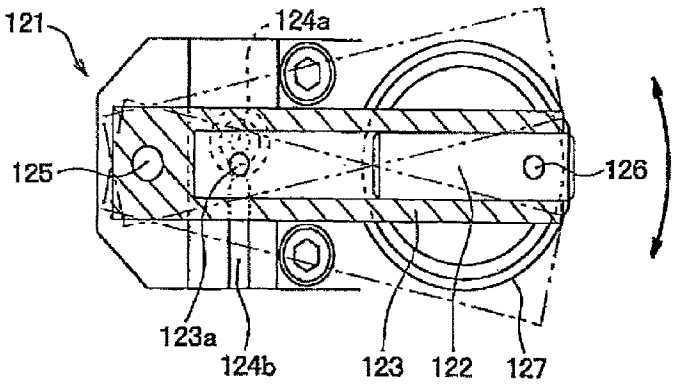
FIGS. 4A to 4C are cross-sectional views each illustrating an engine.
Figure 4A:
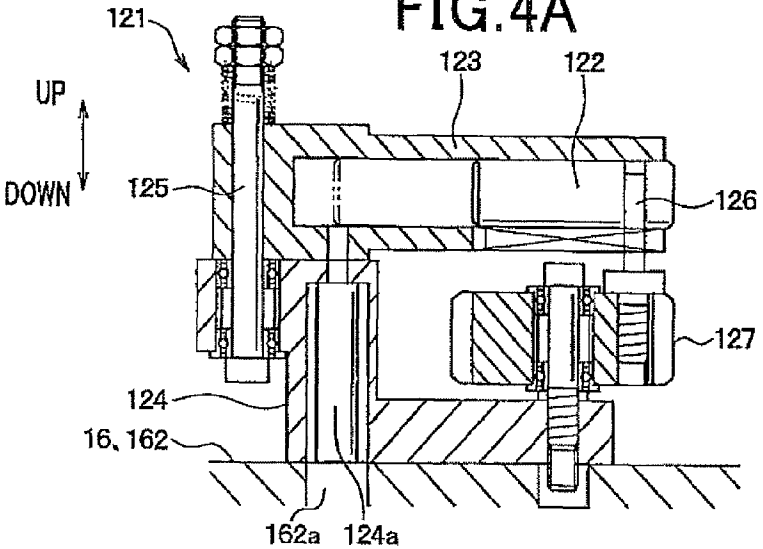
Figure 4C:
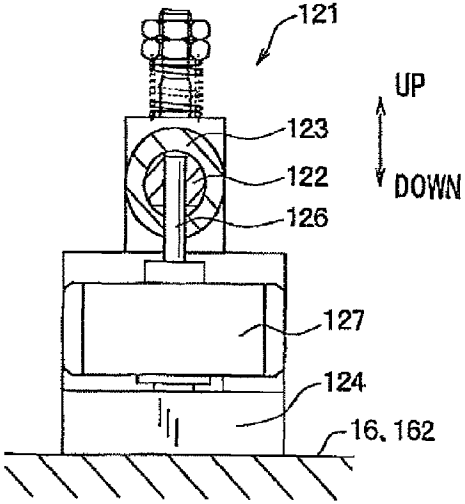

FIGS. 4A to 4C are cross-sectional views each illustrating the engine 121. The cylinders 123 are each supported by a base 124 and allowed to be pivotally movable about an oscillating shaft 125, the base 124 being fixed to the plate-like wall portion 162 of the bulkhead 16.

Each base 124 has a charge path 124*a* which is in communication with the vapor path 162*a*. The charge path 124*a* serves as a channel through which the vapor to be charged into each cylinder 123 flows. Each base 124 also has a discharge path 124*b* which is in communication with the low-pressure chamber 157. The discharge path 124*b* serves as a channel through which the vapor to be discharged from each cylinder 123 flows. An inlet portion of the charge path 124*a* and an outlet portion of the discharge path 124*b* are open in the upper surface of the base 124.

In the present embodiment, the pistons 122 and the cylinders 123 are arranged in the horizontal direction, while the oscillating shafts 125 are arranged in the vertical direction. Accordingly, the pistons 122 and the cylinders 123 are allowed to oscillate in a horizontal plane.

Each cylinder 123 has a lower surface in which a port 123*a* is open to charge/discharge vapor. In a state where each cylinder 123 is positioned on one end side in the oscillation direction, the port 123*a* communicates with the charge path 124*a*. In a state where each cylinder 123 is positioned on the other end side in the oscillation direction, the port 123*a* communicates with the discharge path 124*b*.

When each cylinder 123 is positioned on one end side in the oscillation direction and permits communication between the port 123*a* and the charge path 124*a*, the vapor in the evaporation chamber 156 flows into the cylinder 123 to push the piston 122 forward.

Each piston 122 has a tip end portion which is connected to a wheel gear 127 via a rod 126. As shown in FIG. 1, each wheel gear 127 is engaged with a center gear 128. The center gear 128 has a center to which an output shaft 129 is fixed. Thus, when the piston 122 is pushed forward, the output shaft 129 is rotated via the wheel gear 127 and the center gear 128.

Further, when the piston 122 is pushed forward to rotate the wheel gear 127, the cylinder 123 is oscillated toward the other end side in the oscillation direction. As a result, the port 123*a* is closed by the upper surface of the base 124.

When the port 123*a* is closed, the wheel gear 127 continues rotation by the force of inertia. The force of inertia of the wheel gear 127 then allows the piston 122 to be pushed backward. In this case as well, the oscillation of the cylinder 123 is continued. Then, when the cylinder 123 is positioned on the other end side in the oscillation direction to allow communication between the port 123*a* and the discharge path 124*b*, the vapor in the cylinder 123 is discharged to the low-pressure, chamber 157.

As shown in FIGS. 1 and 3, the engine 121 is a multi-cylinder engine having a plurality of cylinders 123. Alternatively, however, the engine 121 may be a single-cylinder engine having only one cylinder 123.

Connection between the output shaft 129 of the output unit 12 and a rotary shaft 1*a* of the generator 1 is established by magnetic coupling via the upper wall portion 151 of the case 15. Thus, a rotor 1*b* is rotated by the rotation of the rotary shaft 1*a*, and electricity is generated at a coil 1*c* by the rotation of the rotor 1*b*. The electric power generated by the coil is supplied to optional electric equipment 4 which is connected to the generator 1.

As shown in FIG. 1, the condensation unit 13 is arranged on the upper side of the case 15. The upper wall portion 151 of the case 15 has an outflow path 151*a* and a reflux path 151*b*. The outflow path 151*a* allows the vapor of the low-pressure chamber 157 discharged from the output unit 12 to flow out to the condensation unit 13. The reflux path 151*b* refluxes the working fluid 14 condensed in the condensation unit 13 to the low-pressure chamber 157.

The condensation unit 13 is formed of a vessel having a predetermined shape. The inner space of the condensation unit 13 is in communication with the outflow path 151*a* and the reflux path 151*b*. The vapor that has flowed into the condensation unit 13 via the outflow path 151*a* radiates heat into the atmospheric air from the condensation unit 13 and is condensed. In other words, the vapor is restored to the working fluid 14 in the condensation unit 13. The working fluid 14 restored in the condensation unit 13 is refluxed to the low-pressure chamber 157 via the reflux path 151*b* and collected to the fluid-pool chamber 157*a*.

As shown in FIG. 1, a fan 1*d* is connected to the rotary shaft 1*a* of the generator 1 to rotate the fan 1*d* by the rotary shaft 1*a*. Thus, the condensation unit 13 is cooled by the air blown by the rotation of the fan 1*d*. In this way, the amount of heat radiation of the vapor from the condensation unit 13 is increased.

Hereinafter is described an operation in the above configuration. The heat emitted from the heating unit 3 is transferred to the working fluid 14 in the evaporation chamber 156 via the bottom wall portion 152 of the case 15 to thereby evaporate the working fluid 14. The vapor generated in the evaporation chamber 156 is supplied to the engine 121 through the vapor path 162*a*.

The vapor supplied to the engine 121 actuates the pistons 122. Thus, the energy of the vapor is converted to mechanical energy. Then, with the actuation of the pistons 122, the output shaft 129 is rotated to allow the generator 1 to generate electric power. In this way, the exhaust energy of the heating unit 3 is recovered in the form of electric energy.

After actuating the pistons 122, the vapor in the engine 121 is discharged into the low-pressure chamber 157 via the discharge path 124*b*. The vapor discharged to the low-pressure chamber 157 from the engine 121 flows into the condensation unit 13 via the outflow path 151*a*. The vapor is then condensed in the condensation unit 13 and restored to the working fluid 14. The working fluid 14 restored in the condensation unit 13 is refluxed to the low-pressure chamber 157 via the reflux path 151*b* and collected to the fluid-pool chamber 157*a*.

The working fluid 14 collected to the fluid-pool chamber 157*a* is sucked by the wick 17 for supply to the evaporation chamber 156 and then evaporated. Specifically, capillary force for sucking the working fluid 14 in the fluid-pool chamber 157*a* is generated in the wick 17. The capillary force is used to supply the working fluid 14 from the fluid-pool chamber 157*a* having a low pressure to the evaporation chamber 156 having a high pressure.

More specifically, in the boiler unit 11 where the pressure bulkhead 16 is located, the refluxed working fluid 14 of the fluid-pool chamber 157*a* having a low temperature and a low pressure is taken into the evaporation chamber 156 having a high pressure using the capillary force of the wick 17, and the droplets of the working fluid 14 that have reached an end of the wick 17 are successively evaporated.

Since the size of the voids in the wick 17 has been reduced to sufficiently reduce the circle-equivalent radius r of the voids in the wick 17, which satisfies Expression (2), the pressure ΔP of the capillary force of the wick 17 becomes larger than the pressure difference (PH−PL) between the pressure PH in the high-pressure chamber 156 and the pressure PL in the low-pressure chamber 157 (ΔP>PH−PL).

In this way, the capillary force of the wick 17 overcomes the pressure difference (PH−PL) between the pressure PH in the high-pressure chamber 156 and the pressure PL in the low-pressure chamber 157. As a result, the working fluid 14 collected to the fluid-pool chamber 157*a* having a low pressure can be favorably sucked into the evaporation chamber 156 having a high pressure.

In other words, a pressure difference is caused between the fluid-pool chamber 157*a* and the evaporation chamber 156 by the pressure bulkhead 16. In this state, capillary force that would not be defeated by the pressure difference (PH−PL) is given with the aid of the wick 17, so that the working fluid 14 can be taken into the evaporation chamber 156 having a high pressure from the fluid-pool chamber 157*a* having a low pressure. Accordingly, the working fluid 14 of the fluid-pool chamber 157*a* can be circulated to the evaporation chamber 156 having a high pressure without using external energy.

Further, since the amount of evaporation of the working fluid 14 in the evaporation chamber 156 equals to the amount of transfer of the working fluid 14 from the fluid-pool chamber 157*a*, control over the amount of reflux of the working fluid 14 can be autonomously conducted. Accordingly, this can eliminate the use of a control mechanism for controlling the amount of reflux of the working fluid 14, leading to reduction in the size and cost of the apparatus.

In addition, since the voids in the wick 17 are made small, the vapor generated in the evaporation chamber 156 can be prevented from flowing back to the low-pressure chamber 157 via the wick 17.

As described above, in the present embodiment, a material interwoven with stainless steel wires and aramid fibers is used as an example of the wick 17. If the wick 17 is in a unitary state (a state not being compressed) and has voids of a large size, the wick 17 may preferably be compressed to make the fibers dense for the reduction of the size of the voids inside the wick 17 to thereby sufficiently reduce the circle-equivalent radius r of the voids.

In the present embodiment, the cylindrical wall portion 161 of the bulkhead 16 is tightened against the bottom wall portion 152 of the case 15 using the bolts 18 to compress the wick 17 between the cylindrical wall portion 161 and the bottom wall portion 152. Thus, the wick 17 satisfying the relationship of Expression (2) can be readily configured.

A specific example of compressing the wick 17 is provided. The material of the wick 17 may have a thickness of 5 mm and a density of 2.5 m/cm$^3$ and may have fibers with a radius of 8 μm. This material of the wick 17 can be compressed to 12% of the original size to reduce the circle-equivalent radius r of the wick 17 to 12 μm to thereby cause capillary force that can overcome 10 kPa of pressure of the evaporation chamber 156.

In the present embodiment, the wick 17 is compressed by permitting the cylindrical wall portion 161, a part of the bulkhead 16, to impose a load on the wick 17. Therefore, the structure of the apparatus can be simplified compared to the case where a loading means is separately provided to impose a load on the wick 17 to compress the wick 17.

If the voids in the wick 17 are sufficiently small in a unitary state (a state not being compressed) of the wick 17, sufficient capillary force may be obtained if the wick 17 is used without compression. For example, a porous sintered metal plate may be used as such a wick 17.

In the present embodiment, the wick 17 is permitted to extend to the side of the evaporation chamber 156 from beneath the cylindrical wall portion 161. Therefore, the working fluid 14 of the fluid-pool chamber 157*a* can be reliably supplied to the evaporation chamber 156, compared to the case where the wick 17 is arranged only between the cylindrical wall portion 161 and the bottom wall portion 152 of the case 15.

In the present embodiment, the end surface 171 of the wick 17 in the horizontal direction configures an inlet through which the working fluid 14 of the fluid-pool chamber 157*a* flows into the evaporation chamber 156, allowing the wick 17 to suck the working fluid 14 in the horizontal direction. Therefore, the influence of gravity can be suppressed when the working fluid 14 is sucked by the wick 17. In this way, the working fluid 14 of the fluid-pool chamber 157*a* can be reliably supplied by the wick 17 into the evaporation chamber 156.

In the present embodiment, the wick 17 is formed into a plate-like shape extending in the horizontal direction and mounted on the bottom wall portion 152. Therefore, the flat portion (lower surface portion) 173 of the wick 17 on the side of the bottom wall portion 152 can receive heat from the heating unit 3 via the bottom wall portion 152. In this way, the heat receiving area of the wick 17 can be ensured to be large, leading to effective heating of the working fluid 14 sucked into the wick 17.

In the present embodiment, the through hole 172 extending in the vertical direction is formed in a portion of the wick 17, which portion is positioned inside the evaporation chamber 156. Therefore, the vapor evaporated by being heated at the bottom wall portion 152 can promptly escape to the upper side of the wick 17 from the through hole 172. Thus, it is unlikely that suction of the working fluid 14 is prevented, which would otherwise be caused by the vapor that has stayed in the wick 17 for heating and drying of the inside of the wick 17.

In the present embodiment, the bottom wall portion 152 has a heat insulating groove 152*a* having a circular shape for suppressing heat transfer in the bottom wall portion 152. The heat insulating groove 152*a* is located at a portion on the side of the fluid-pool chamber 157*a* with reference to the through hole 172. Thus, the inner portion 152*b* located inner side of the circular heat insulating groove 152*a* of the bottom wall portion 152 is brought into contact with the heating unit 3.

Thus, heat is easily received in a portion near the through hole 172 of the wick 17, while heat reception is suppressed in a portion distanced from the through hole 172 of the wick 17 (portion on the side of the fluid-pool chamber 157*a*).

As a result, the vapor generated by the heating of the bottom wall portion 152 can more promptly escape from the through hole 172 to the upper side of the wick 17. Thus, it is more unlikely that suction of the working fluid 14 is prevented, which would otherwise be caused by the vapor that has stayed in the wick 17 for the heating and drying of the inside of the wick 17.

In this way, it is ensured that the flow of the working fluid 14 in the wick 17 is not interrupted. At the same time, the occurrence of loss (heat loss) can be suppressed, with which the heat of the heating unit 3 would escape to the case 15.

It should be appreciated that, in the present embodiment, the pressure in the case 15 is not reduced but kept at the atmospheric pressure and the temperature of the external heat source is set to 230° C. Thus, during operation, the temperature in the high-pressure chamber 156 is ensured to be 102° C. and that in the low-pressure chamber 157 to be 97° C.

The boiling point of the working fluid 14 depends on the material of the working fluid 14 and the pressure in the case 15. Therefore, for example, if alcohol is used as the working fluid 14 and the case 15 is vacuumized, the temperature of the external heat source may be zero or less. In the case where the temperature of the external heat source is low, the wick 17 and the structure of the boiler unit 11 (e.g., case 15) are not required to have heat resistance. Accordingly, materials having low heat resistance (e.g. resins) may be used as the materials for the wick 17 and the boiler unit 11.

(Modifications)

In the above embodiment, the condensation unit 13 has been arranged on the upper side of the case 15. However, the arrangement is not limited to this, but, for example, the condensation unit 13 may be arranged beside the case 15.

Further, depending on the position of the condensation unit 13, appropriate change may be made in the specific configuration of the outflow path 151*a* for flowing out the vapor in the low-pressure chamber 157 to the condensation unit 13, and the reflux path 151*b* for refluxing the working fluid 14 condensed in the condensation unit 13 into the low-pressure chamber 157.

In the above embodiment, the case 15 has been configured by a single vessel. Alternatively, however, the case 15 may be configured by a plurality of vessels with appropriate connection therebetween via piping. For example, the fluid-pool chamber 157*a* may be configured as a separate vessel, while the fluid-pool chamber 157*a* and the evaporation chamber 156 may be connected by piping. In this case, the wick 17 may be arranged in the piping that connects the fluid-pool chamber 157*a* and the evaporation chamber 156.

(Second Embodiment)

The configuration of an exhaust heat recovery apparatus of the present embodiment is based on the configuration of the exhaust heat recovery apparatus of the first embodiment.

Figure 5A:
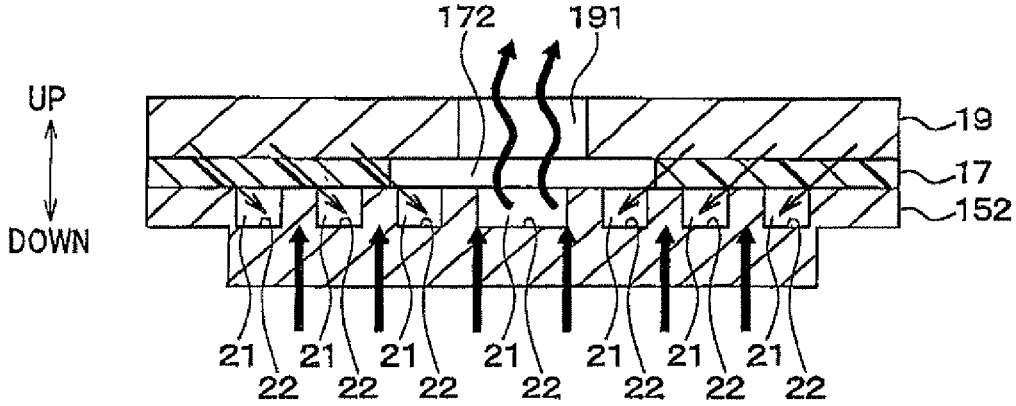
FIGS. 5A and 5B are a cross-sectional view and a plain view illustrating a main part of a boiler unit.
Figure 5B:
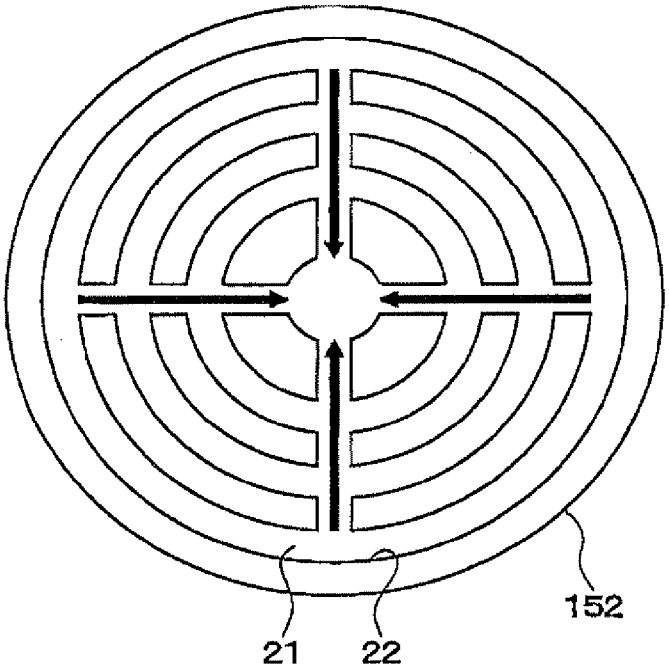

As shown in FIGS. 5A and 5B, in the present embodiment, the bottom wall portion 152 of the case 15 has a discharge path 21. Specifically, the discharge path 21 is configured by grooves 22. Of the bottom wall portion 152, the grooves 22 are formed in a portion which is in contact with the wick 17. The grooves 22 are formed being aligned with the through hole 172 of the wick 17. Accordingly, the through hole 172 of the wick 17 is in communication with the discharge path 21.

As shown in FIGS. 5A and 5B, the discharge path 21 is configured by a plurality of concentric circular grooves and a plurality of straight grooves radially connecting the circular grooves.

According to this configuration, the vapor of the working fluid 14 evaporated from the lower surface of the wick 17 passes through the discharge path 21 and reaches the through hole 172 of the wick 17. The vapor that has reached the through hole 172 of the wick 17 is then discharged to the upper side of the wick 17.

Thus, owing to the formation of the discharge path 21 in the bottom wall portion 152 of the case 15, the vapor evaporated from the lower surface of the wick 17 can be easily escape to the upper side of the wick 17. Thus, the vapor of the working fluid 14 can be easily discharged, and further, the output can be improved.

The vapor is further heated while it passes through the discharge path 21 and turns to superheated vapor which will help increase the vapor pressure, resulting to increase the engine thrust. In other words, the output energy is increased. However, increasing the scale of the discharge path 21 will decrease the heat-transfer area. Therefore, dischargeability and heat conductivity are in a trade-off relationship.

Figure 6A:
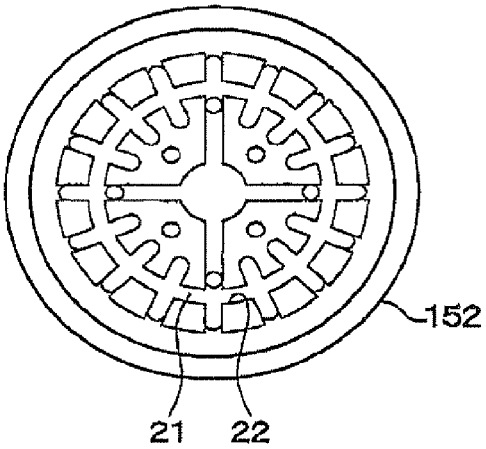
FIGS. 6A to 6D are plain views illustrating patterns of grooves.

As shown in FIGS. 6A to 6D, the pattern of the grooves 22 may be variously changed. For example, as shown in FIG. 6A, the pattern of the grooves 22 may be formed by combining one circular groove with a plurality of two types of long and short straight grooves, such that the long and short straight grooves will radially intersect the circular groove.

Figure 6B:
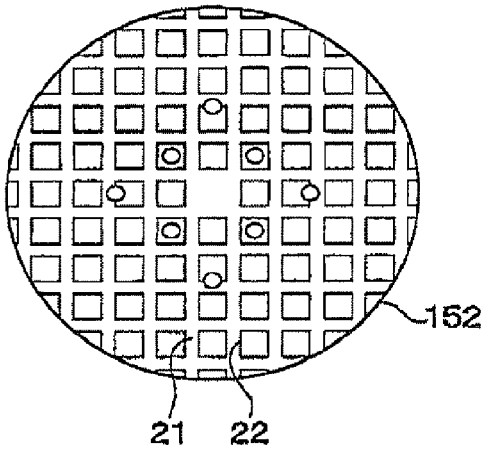
Figure 6C:
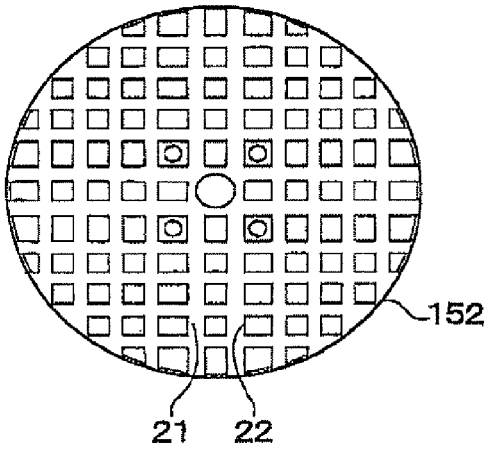
Figure 6D:
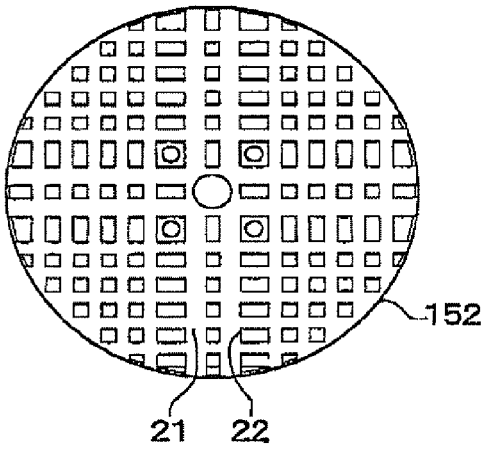

For example, as shown in FIG. 6B, the pattern of the grooves 22 may be formed by a plurality of straight grooves which are arranged so as to be orthogonal to each other. Further, as shown in FIGS. 6C and 6D, the pitch of the straight grooves may be appropriately changed.

(Third Embodiment)

In the second embodiment described above, the discharge path 21 has been configured by the grooves 22. In the present embodiment, as shown in FIG. 7, the discharge path 21 is configured by sandwiching discharge path forming members 23 between the bottom wall portion 152 of the case 15 and the wick 17.

(Description A1)

The discharge path forming members 23 are each formed of metal, for example, having good heat conductivity and are ensured to play a role of transferring heat from the bottom wall portion 152 of the case 15 to the wick 17. In other words, in the present embodiment, a heat-transfer member in charge of transferring heat from the heating unit 3 to the wick 17 is divided into the member that configures the bottom wall portion 152 and the discharge path forming members 23.

Figure 7:
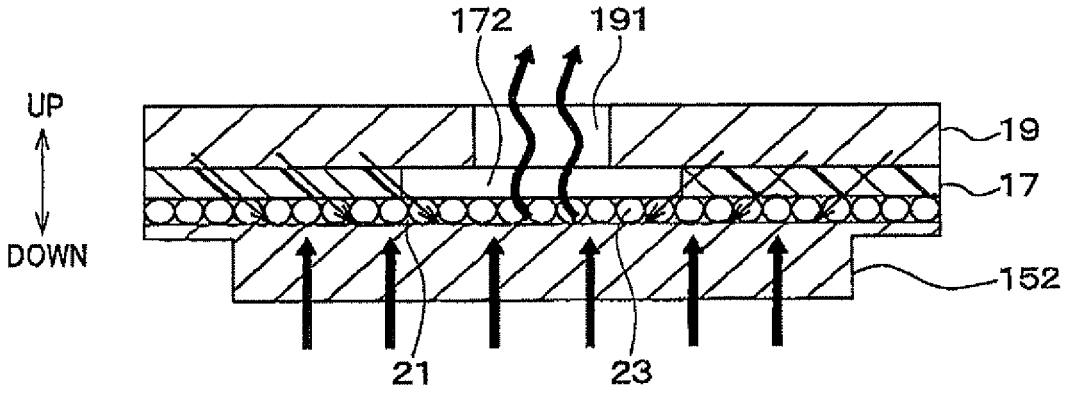
FIG. 7 is a cross-sectional view illustrating a main part of a boiler unit.

In FIG. 7, a plurality of ball-like members are used as the discharge path forming members 23. For example, the ball-like members may be bearing balls having a diameter ϕ3. Use of the plurality of ball-like members as the heat-transfer member can form gaps between the bottom wall portion 152 of the case 15 and the wick 17. The gaps will allow the vapor to flow therethrough and will function as the discharge path 21.

The heat-transfer member 23 that forms the discharge path may be replaced by a mesh member. The mesh member may preferably be a woven wire mesh. For example, a linear 0.5 mm stainless steel mesh may be used.

The woven wire mesh is a wire mesh woven with warp wires and woof wires which are arranged at regular intervals, each warp wire and each woof wire alternately intersecting each other. The warp wires and the woof wires of the woven wire mesh have wavelike forms. Accordingly, use of the woven wire mesh replacing the heat-transfer members 23 can form gaps between the bottom wall portion 152 of the case 15 and the wick 17. The gaps will allow the vapor to flow therethrough and will function as the discharge path 21.

In the present embodiment as well, advantages similar to those in the second embodiment can be obtained.

(Fourth Embodiment)

Figure 8A:
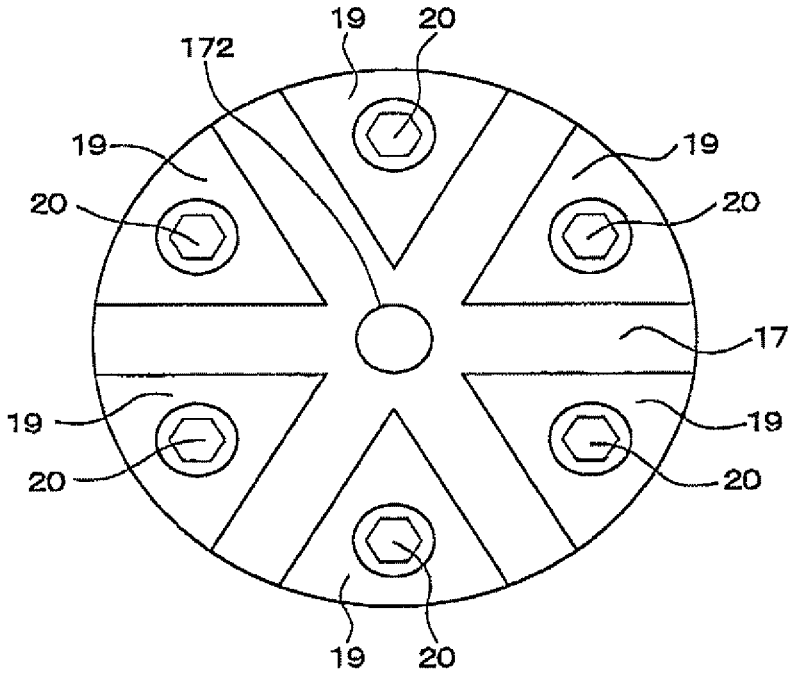
FIGS. 8A and 8B are a plain view and a cross-sectional view illustrating a main part of a boiler unit.
Figure 8B:
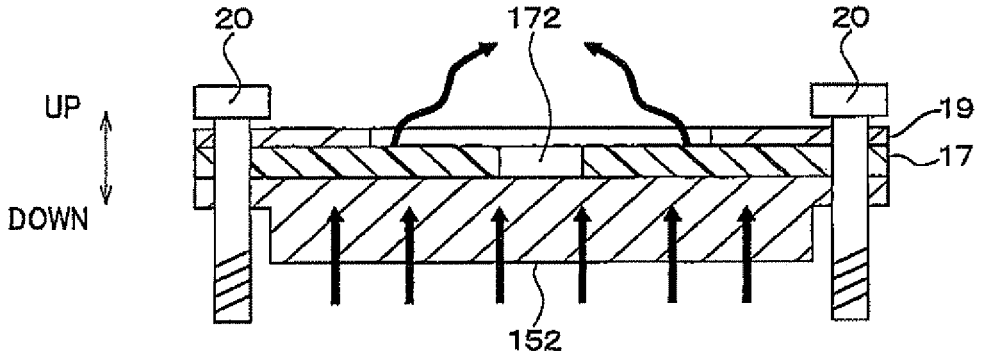

In the embodiments described above, the plate 19 has played a role of preventing the uplift of the center portion of the wick 17. In the present embodiment, however, as shown in FIGS. 8A and 8B, the plate 19 also plays a role of a heat-transfer plate that transfers heat from the heating unit 3 to the wick 17.

(Description A2)

Accordingly, the plate 19 of the present embodiment is formed of a material having good heat conductivity. As shown in FIGS. 8A and 8B, the plate 19 is divided into a plurality of fan-like segment plates with a predetermined interval therebetween.

With this configuration of the plate 19, a heat-transfer route is formed by way of heating unit 3→bottom wall portion 152 of case 15→bolts 20→plate 19→wick 17. Thus, the wick 17 will be heated from the side of the upper surface thereof. Therefore, the working fluid 14 is evaporated from the upper surface of the wick 17, whereby discharge of the vapor of the working fluid 14 is enhanced, and further, the output can be improved.

(Fifth Embodiment)

Figure 9:
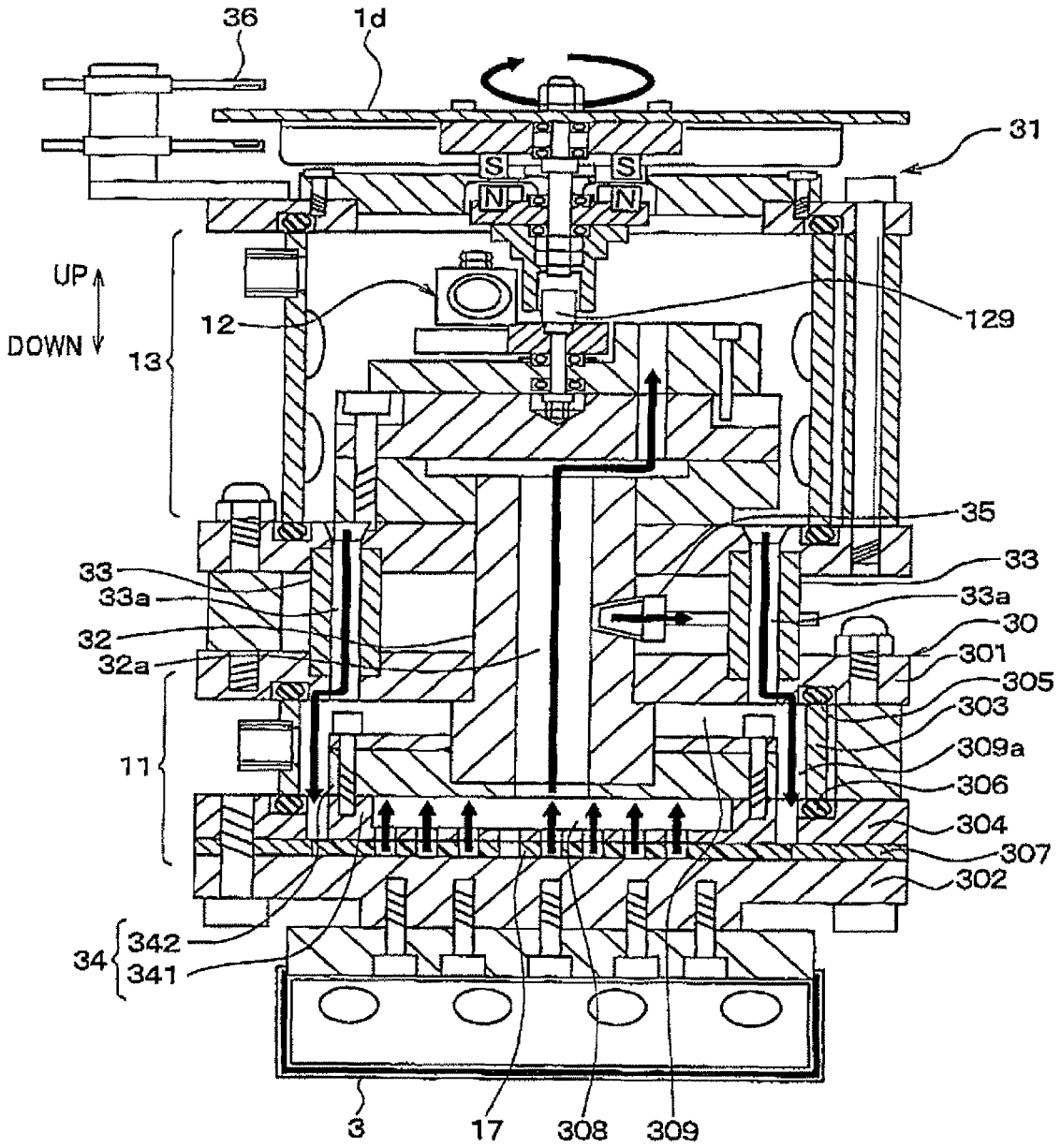
FIG. 9 is a cross-sectional view illustrating an exhaust heat recovery apparatus.

In the embodiments described above, the boiler unit 11 and the output unit 12 have been accommodated in the single case 15. In the present embodiment, however, as shown in FIG. 9, the boiler unit 11 is accommodated in a boiler unit case 30, while the output unit 12 and the condensation unit 13 are accommodated in a reflux unit case 31.

(Description A3)

The boiler unit case 30 and the reflux unit case 31 are disposed being distanced from each other while being connected via a vapor path forming portion 32 and a circulation path forming portion 33. The vapor path forming portion 32 forms a vapor path 32*a* that allows communication between the boiler unit 11 and the output unit 12. The circulation path forming portion 33 forms a circulation path 33*a* that allows communication between the condensation unit 13 and the boiler unit 11.

According to this configuration, the output unit 12 and the condensation unit 13 are disposed being separated from the boiler unit 11. Accordingly, the heat of the boiler unit 11 is unlikely to be transferred to the output unit 12 and the condensation unit 13, thereby suppressing temperature rise of the output unit 12 and the condensation unit 13. Thus, condensation/reflux performance for the vapor discharged from the output unit 12 is improved.

In FIG. 9, the boiler unit case 30 and the reflux unit case 31 are configured as set forth below.

The boiler unit case 30 is mounted on the heating unit 3 that serves as an external heat source. The boiler unit case 30 is configured by two plates 301, 302 extending in the horizontal direction and cylinders 303, 304 extending in the vertical direction between the two plates 301, 302. Specifically, upper and lower wall portions of the boiler unit case 30 are configured by the plates 301, 302 and a side wall portion of the boiler unit case 30 is configured by the cylinders 303, 304. The cylinder 303 is disposed on the upper side of the cylinder 304.

In the present embodiment, water is used as the working fluid 14. Therefore, it is preferable that the plates 301, 302 and the cylinders 303, 304 are formed of stainless steel having good water resistance. The plates 301, 302 and the cylinders 303, 304 are interposed with sealing members 305, 306 and 307. The sealing member 307 interposed between the plate 302 and the cylinder 304 is formed into an annular shape and also serves as a spacer for adjusting the vertical position of the cylinder 304.

In the interior of the boiler unit case 30, a high-pressure chamber 308 and a low-pressure chamber 309 are defined by a bulkhead 34. The bulkhead 34 is divided into a cylindrical wall portion 341 disposed on a lower wall portion (plate) 302 of the boiler unit case 30, and a plate-like wall portion 342 overlaid on the cylindrical wall portion 341. In the present embodiment, the cylindrical wall portion 341 is formed into a bottomed cylindrical shape, while the plate-like wall portion 342 is formed into a disc-like shape. The bottom portion of the cylindrical wall portion 341 serves as a pate for preventing uplift of the wick 17.

The bulkhead 34 is made of a heat-insulating material having heat resistance, such as a heat-resistant resin, in order that the vapor in the high-pressure chamber (evaporation chamber) 308 would not be cooled and condensed.

The evaporation chamber 308 is allowed to communicate with the vapor path 32*a*. The vapor path forming portion 32 that forms the vapor path 32*a* passes through the upper wall portion (plate) 301 of the boiler unit case 30 and is connected to plate-like wall portion 342 of the bulkhead 34. The vapor path forming portion 32 is provided with a sensor 35 for measuring vapor pressure.

The low-pressure chamber 309 is allowed to communicate with the circulation path 33*a*. The circulation path forming portion 33 that forms the circulation path 33*a* is connected to the upper wall portion 301 of the boiler unit case 30.

In the low-pressure chamber 309, the space formed between the cylinders 303, 304 of the boiler unit case 30 and the cylindrical wall portion 341 of the bulkhead 34 configures a fluid-pool chamber 309*a* for collecting the working fluid 14 supplied to the evaporation chamber 308. Specifically, the fluid-pool chamber 309*a* is horizontally juxtaposed with the evaporation chamber 308.

The wick 17 is sandwiched between the bottom wall portion (lower wall portion) 302 of the boiler unit case 30 and the cylindrical wall portion 341 of the bulkhead 34. The wick 17 is held in the boiler unit case 30 in the state of being loaded by the cylindrical wall portion 341 and being compressed.

Since the bottom wall portion 302 of the boiler unit case 30 is thermally connected to the heating unit 3, the wick 17 receives heat from the heating unit 3 via the bottom wall portion 302 of the boiler unit case 30. Accordingly, the bottom wall portion 302 of the boiler unit case 30 serves as a heat-transfer member.

The reflux unit case 31 is disposed on the upper side of the boiler unit case 30. The output unit 12 is attached to a center portion of the lower surface of the reflux unit case 31. The reflux unit case 31 has a lower-surface outer peripheral side portion to which the circulation path forming portion 33 forming the circulation path 33*a* is connected. In the inner space of the reflux unit case 31, the condensation unit 13 is configured by a space around the output unit 12.

The reflux unit case 31 is attached with a sensor 36 to measure the number of rotations of the fan 1*d*.

According to the above configuration, the heat of the heating unit 3 is transferred to the working fluid 14 in the evaporation chamber 308 via the bottom wall portion 302 of the boiler unit case 30, for evaporation of the working fluid 14. The vapor generated in the evaporation chamber 308 is supplied to the output unit 12 through the vapor path 32*a*. Thus, the energy of the vapor is converted to mechanical energy.

The heat of the vapor discharged from the output unit 12 is radiated to the atmospheric air from the condensation unit 13, for condensation of the vapor. The working fluid 14 condensed in the condensation unit 13 is refluxed to the low-pressure chamber 309 through the circulation path 33*a* and collected to the fluid-pool chamber 309*a*. The working fluid 14 collected to the fluid-pool chamber 309*a* is sucked by the wick 17 for supply to the evaporation chamber 308, and then evaporated in the evaporation chamber 308.

Thus, in the present embodiment as well, the working fluid 14 of the fluid-pool chamber 309*a* can be circulated to the evaporation chamber 308 having a high pressure without using the external energy.

Although not shown, in the present embodiment as well, the so discharge path 21 can be formed in the bottom wall portion 302 of the boiler unit case 30, as in the second and third embodiments described above. Thus, the vapor evaporated from the lower surface of the wick 17 is allowed to easily escape to the upper side of the wick 17, and further, the output can be enhanced.

(Sixth Embodiment)

Hereinafter is described a sixth embodiment. The present embodiment specifically exemplifies the configuration of the through hole 172 of the wick 17 of the above embodiments.

(Description A4)

Figure 10A:
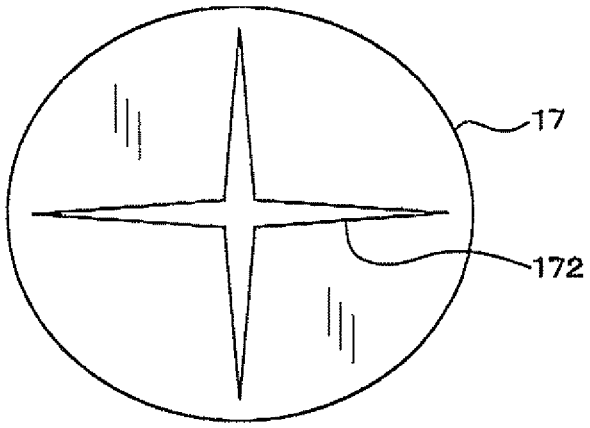
FIGS. 10A and 10B are a plain view and a cross-sectional view illustrating a main part of a boiler unit.
Figure 10B:
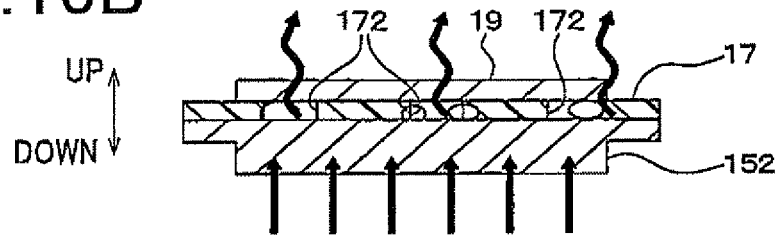

As shown in FIGS. 10A and 10B, the through hole 172 that passes though the wick 17 (from the upper surface of the through hole 172 to the lower surface of the through hole 172) may be formed as a groove extending along the plate surface of the wick 17. Specifically, the through hole 172 may be formed as a cross-shaped groove radially extending in four directions from the center of the wick 17.

Figure 11A:
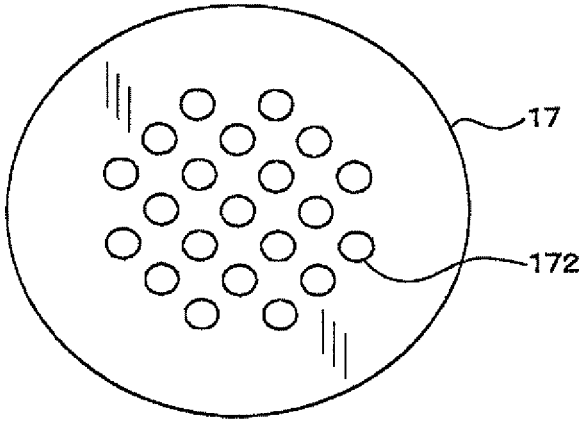
FIGS. 11A and 11B are a plain view and a cross-sectional view illustrating a main part of a boiler unit.
Figure 11B:
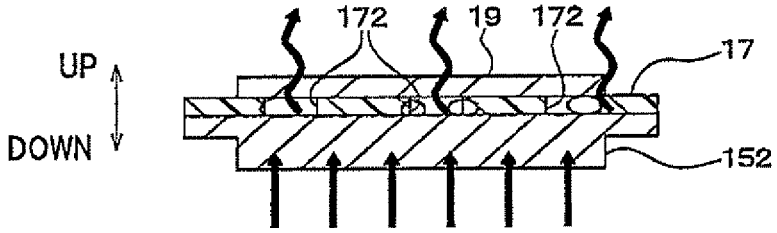

The through hole 172 may be modified as shown in FIGS. 11A and 11B, i.e. may be provided by a large number and scattered. Specifically, the through hole 172 may be configured by a number of circular holes which are scattered in the plate of the wick 17.

According to this configuration, since vapor is generated from the edges (interfaces) of the through holes 172, the amount of vapor can be increased, and further the output can be enhanced. In the examples shown in FIGS. 10A and 10B as well as FIGS. 11A and 11B, in particular, the length of the edges (interfaces) of the through holes 172 as a whole can be increased. Thus, the amount of vapor is increased, and further the output can be enhanced.

In the examples shown in FIGS. 10A and 10B as well as FIGS. 11A and 11B, the plate 19 is configured by a meshed, plate. Thus, even in the case where the through holes 172 are formed over a wide range, the occurrence of uplift of the wick 17 can be prevented without preventing discharge of the vapor from the edges (interfaces) of the through holes 172.

(Seventh Embodiment)

Figure 12:
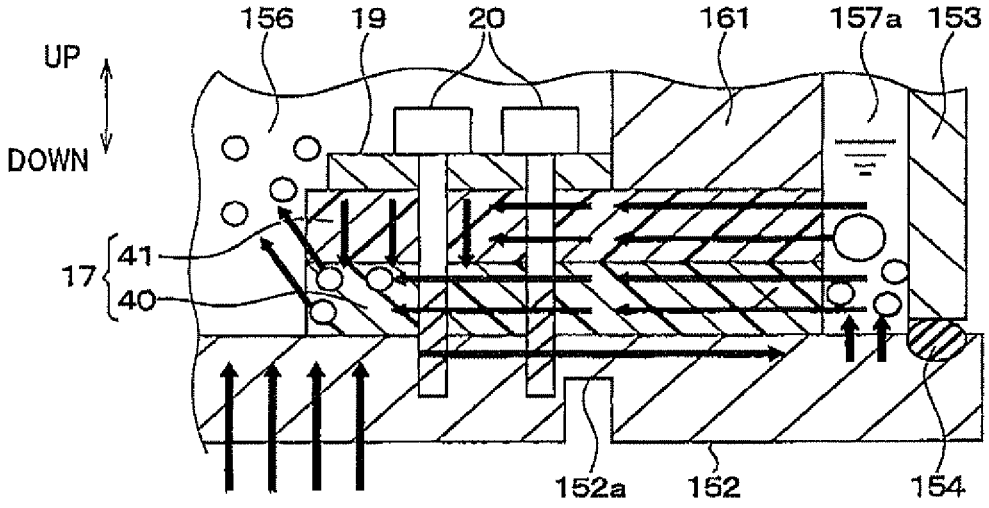
FIG. 12 is a cross-sectional view illustrating a main part of a boiler unit.

Hereinafter is described a seventh embodiment. In the embodiments described above, the wick 17 has been configured by a single plate-like wick. In the present embodiment, however, as shown in FIG. 12, the wick 17 is configured by a lamination of a plurality of plate-like wicks (plate-like working fluid guide members) 40, 41. In the present embodiment, the plate-like wicks 40, 41 are each formed of an interwoven material of stainless steel wires and aramid fibers (resin fibers). The plate-like wicks 40, 41 may each be formed of RAB (mixture of aramid fibers and rock wool particles).

In the present embodiment, the plate-like wicks 40, 41 having the same outer diameter are laminated, with the outer peripheral edge portions of the wicks being aligned with the outer peripheral surface of the cylindrical wall portion 161 of the bulkhead 16.

According to this configuration, the working fluid 14 of the fluid-pool chamber 157*a* is sucked into the plate-like wicks 40, 41 and flows toward the center side of the plate-like wicks 40, 41. Of the plate-like wicks 40, 41, the wick 40 adjacent to the bottom wall portion 152 of the case 15 has a center portion from which the working fluid 14 is evaporated which is heated by the bottom wall portion 152.

The working fluid 14 is horizontally supplied to the center portion of the plate-like wick 40 from a radially outward side of the wick 40. In addition to that, the working fluid 14 is also vertically supplied to the center portion of the plate-like wick 40 from a center portion of the other plate-like wick 41. Thus, suppliability of the working fluid 14 is enhanced, and further the output can be enhanced.

(Eighth Embodiment)

Figure 13:
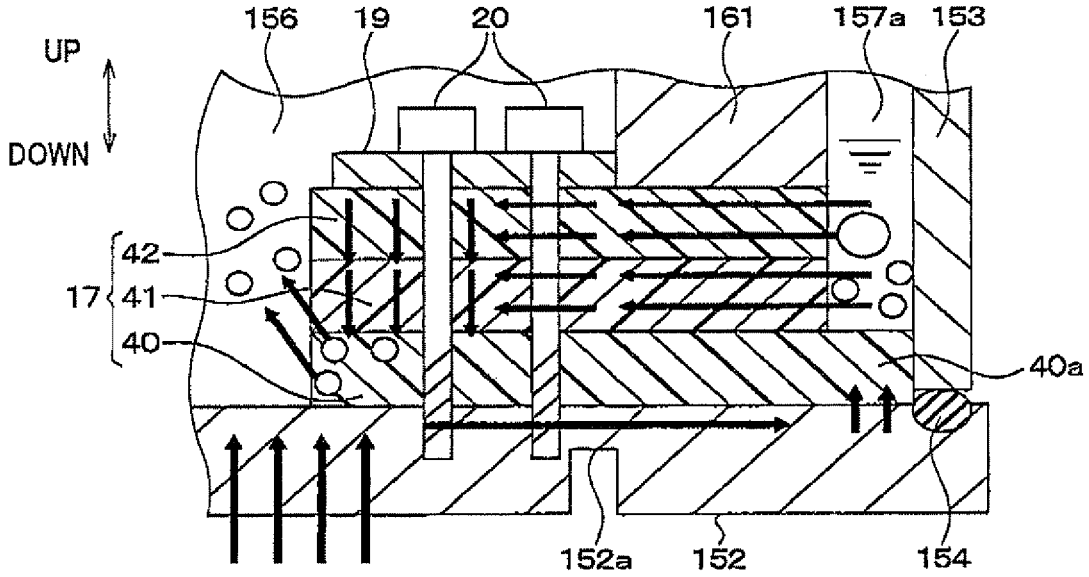
FIG. 13 is a cross-sectional view illustrating a main part of a boiler unit.

Hereinafter is described an eighth embodiment. In the seventh embodiment described above, the outer peripheral edge portions of the plate-like wicks 40, 41 have been aligned with the outer peripheral surface of the cylindrical wall portion 161 of the bulkhead 16. In the present embodiment, however, as shown in FIG. 13, of the plate-like wicks 40, 41 and 42, the wick 40 which is adjacent to the bottom wall portion 152 of the case 15 has an outer peripheral side portion 40*a* extended to the inner peripheral surface of the cylinder 153.

According to this configuration, the outer peripheral side portion 40*a* of the wick 40 overlaps with a portion of the bottom wall portion 152, which faces the fluid-pool chamber 157*a*, to insulate the fluid-pool chamber 157*a* from heat. As a result, the working fluid 14 can be suppressed from being evaporated in the fluid-pool chamber 157*a*. In this way, the working fluid 14 of the fluid-pool chamber 157*a* can be reliably supplied to the evaporation chamber 156, and further the output can be enhanced.

In the present embodiment as well, provision of the discharge path 21 in a similar manner to the second and third embodiments can achieve the advantages similar to those in the second and third embodiments.

(Modifications)

In the second to fourth embodiments, the condensation unit 13 has been arranged on the upper side of the case 15. However, the arrangement is not limited to this, but, for example, the condensation unit 13 may be arranged beside the case 15.

Further, depending on the position of the condensation unit 13, appropriate change may be made in the specific configuration of the outflow path 151*a* for flowing out the vapor in the low-pressure chamber 157 to the condensation unit 13, and the reflux path 151*b* for refluxing the working fluid 14 condensed in the condensation unit 13 into the low-pressure chamber 157.

In the embodiments described above, the boiler unit 11 has been accommodated in a single case. Alternatively, however, the boiler unit 11 may be divided and accommodated in a plurality of cases with appropriate connection therebetween via piping. For example, the fluid-pool chamber 157*a* of the boiler unit 11 may be accommodated in a separate case and then the fluid-pool chamber 157*a* may be connected to the evaporation chamber 156 via piping. In this case, the wick 17 can be arranged in the piping connecting between the fluid-pool chamber 157*a* and the evaporation chamber 156.

(Ninth Embodiment)

The configuration of an exhaust heat recovery apparatus of the present embodiment is based on the configuration of the exhaust heat recovery apparatus of the first embodiment.

Figure 14:
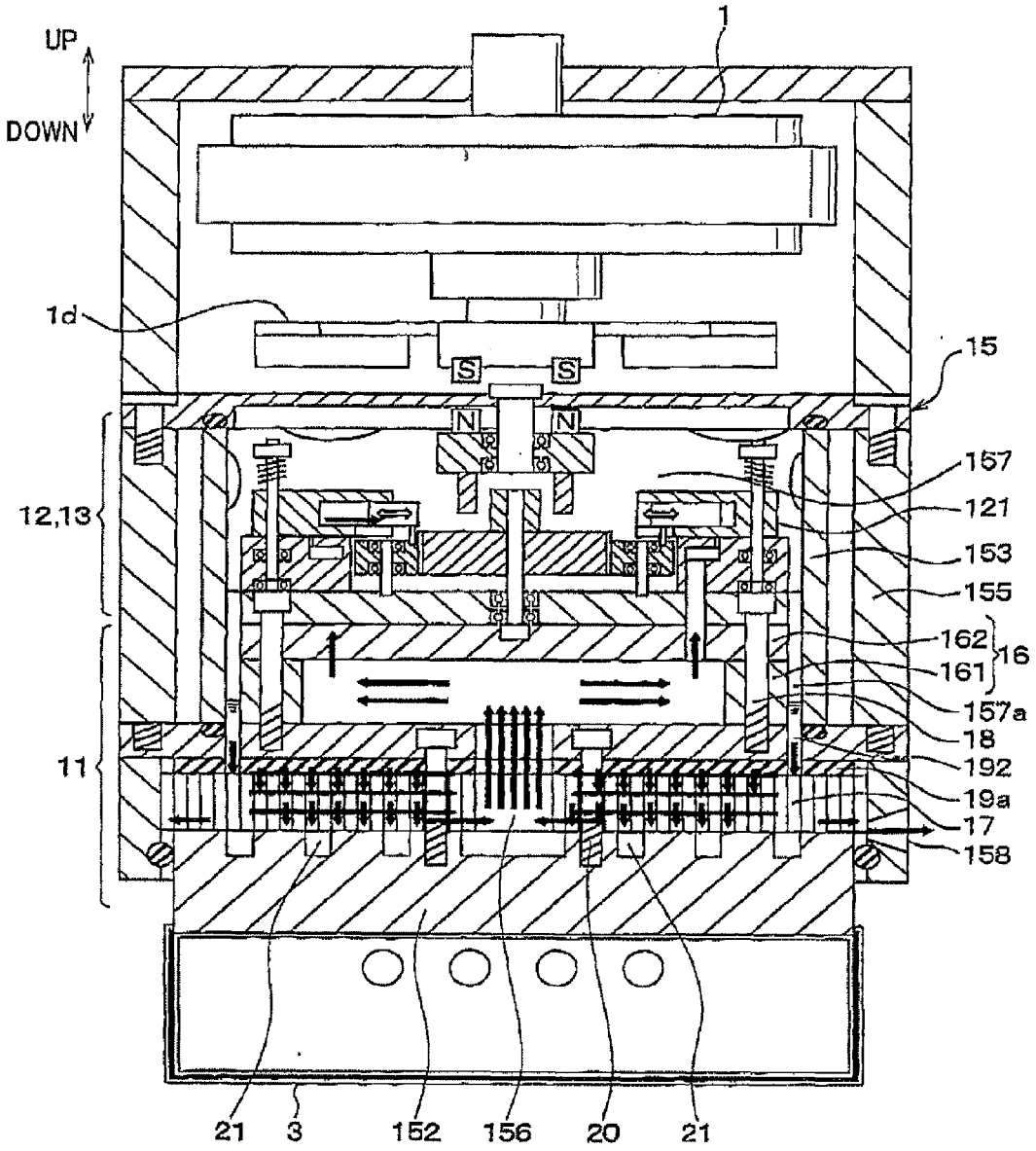
FIG. 14 is a cross-sectional view illustrating an exhaust heat recovery apparatus.

In the present embodiment, as shown in FIG. 14, the configuration of the boiler unit 11 has been changed from the one in the first embodiment. Hereinafter are explained the changes from the first embodiment.

The fluid-pool chamber 157*a* is arranged on the upper side of the wick 17. In other words, the wick 17 is interposed between the bottom wall portion 152 of the case 15 and the fluid-pool chamber 157*a*. Thus, the wick 17 is present in the heat-transfer route starting from the heating unit 3 to the fluid-pool chamber 157*a*.

As shown in FIG. 14, the diameter of the lower portion of the cylindrical case 15 is made larger than that of the remaining portion of the case 15. The wick 17 is arranged in the lower portion of the case 15 having the enlarged diameter. The fluid-pool chamber 157*a* is formed in a portion of the case 15 on the upper side of the wick 17 (i.e. portion of the case 15 where the diameter is not enlarged).

The wick 17 is a fiber assembly (fiber-layer lamination) having a plurality of fiber layers laminated one on the other. In the present embodiment, the wick 17 is a mixture of aramid fibers, i.e. thermoplastic resin fibers, and rock wool particles.

Figure 15A:
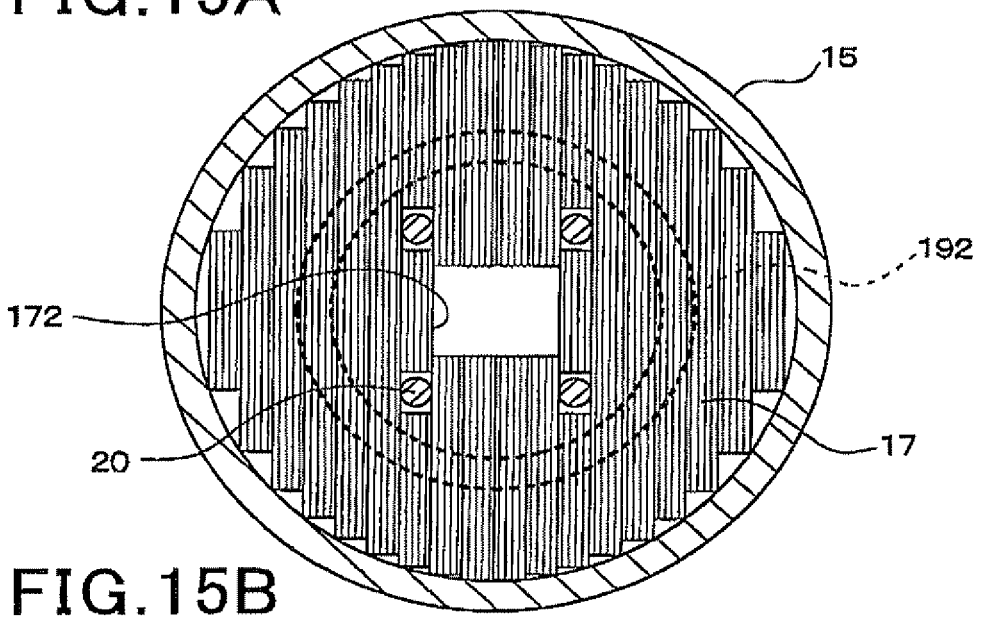
FIGS. 15A to 15C are cross-sectional views illustrating a main part of a boiler unit.
Figure 15B:
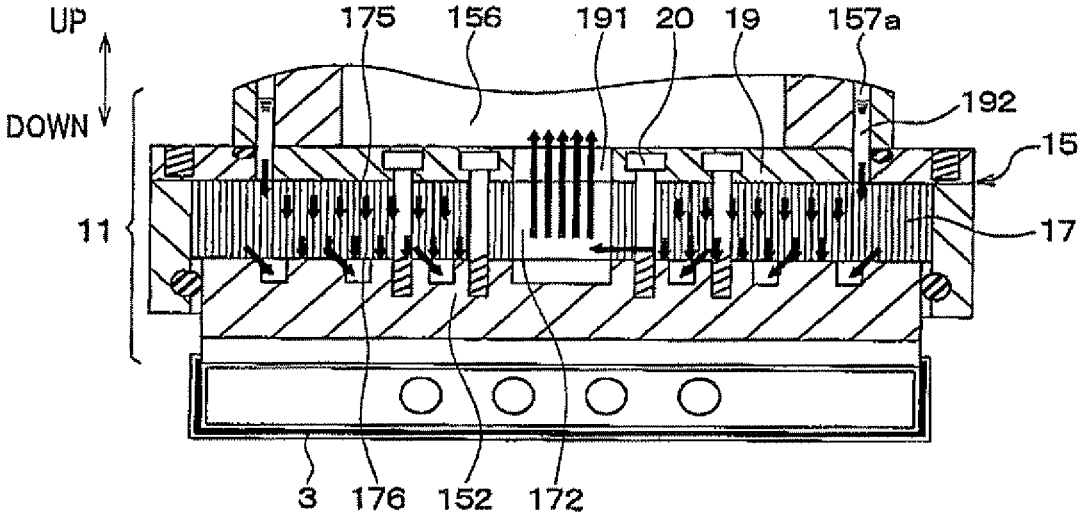
Figure 15C:
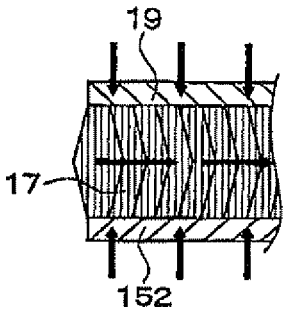

FIGS. 15A to 15C are cross-sectional views each illustrating a portion in the vicinity of the wick 17 shown in FIG. 14. The wick 17 is formed by integrally joining a number of strip-like materials arranged in an array. In FIGS. 15A to 15C, the interface portions between the strip-like materials are indicated by thin solid lines for the convenience of illustration. The interface portions of the strip-like materials of the wick 17 extend from the side of a suction portion 175 of the wick 17 toward the side of a heat-reception portion 176 of the wick 17.

The suction portion 175 of the wick 17 refers to a portion that sucks the working fluid 14 of the fluid-pool chamber 157*a*. The heat-reception portion 176 of the wick 17 refers to a portion that receives heat from the heating unit 3.

As shown in FIG. 14, the fluid-pool chamber 157*a* is arranged on the upper side of the evaporation chamber 156. Accordingly, the suction portion 175 of the wick 17 is configured by the upper surface portion of the wick 17, while the heat-reception portion 176 of the wick 17 is configured by the lower surface portion of the wick 17. Thus, the interface portions between the strip-like materials of the wick 17 extend in the width direction (vertical direction) of the wick 17.

Although not shown, the fiber layers of the wick 17 extend parallel to the interface portions between the strip-like materials. Accordingly, the fiber layers of the wick 17 extend from the side of the suction portion 175 of the wick 17 toward the side of the heat-reception portion 176 of the wick 17. Specifically, the fiber layers of the wick 17 extend in the thickness direction (vertical direction) of the wick 17.

An outline of the method of manufacturing such a wick 17 will be described referring to FIGS. 16A to 16F. First, a plate-like material W1 is prepared as shown in FIG. 16A.

The plate-like material W1 is a fiber assembly (fiber-layer lamination) having a plurality of fiber layers laminated one on the other. The material W1 is formed so as to have a predetermined thickness by repeatedly performing a paper-pressing process. In the present embodiment, the plate-like material W1 is a mixture of aramid fibers, i.e. thermoplastic resin fibers, and rock wool particles. Also, in the present embodiment, the plate-like material W1 is made as thin as about 4 mm.

Figure 16A:
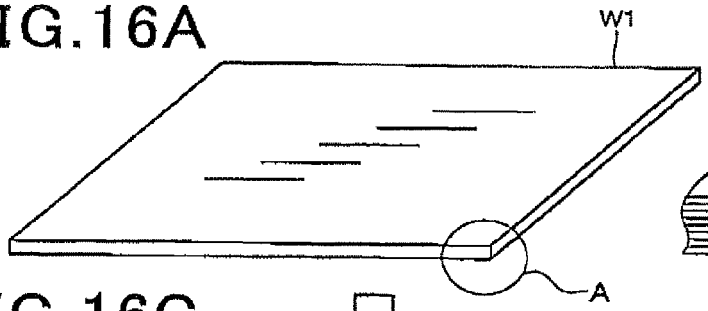
FIGS. 16A to 16F are diagrams for explaining a method of manufacturing a wick.
Figure 16B:
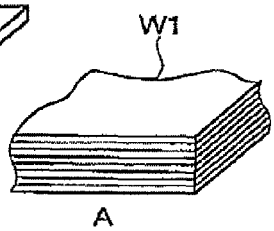

FIG. 16B is an enlarged view of "A" portion of FIG. 16A. In FIG. 16B, the interfaces between the fiber layers are indicated by thin solid lines for the convenience of illustration. As shown in FIG. 16B, the plurality of fiber layers configuring the plate-like material W1 are laminated in the thickness direction of the material W1. In other words, the plurality of fiber layers configuring the material W1 extend parallel to the plate surface of the material W1.

Figure 16C:
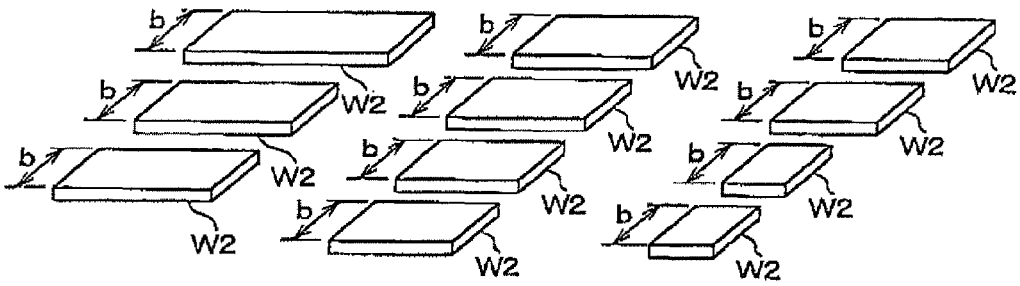

As shown in FIG. 16C, the plate-like material W1 is cut into a number of strip-like materials W2. In this case, the strip-like materials W2 are ensured to have the same width dimension b.

Figure 16D:
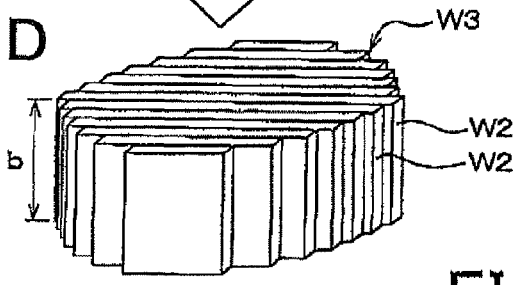

Then, as shown in FIG. 16D, these strip-like materials W2 are juxtaposed in the thickness direction of the materials W2 with no gaps therebetween to obtain a plate-like arrangement assembly W3. Specifically, since the strip-like materials W2 have the same width dimension b, both end surfaces in the width direction of the individual strip-like materials W2 constitute both plate surfaces of the arrangement assembly W3.

In the plate-like arrangement assembly W3 obtained in this way, the fiber layers will extend in the thickness direction of the assembly W3. In other words, the arrangement assembly W3 has fiber layers that extend perpendicular to the plate surfaces of the assembly W3.

Figure 16E:
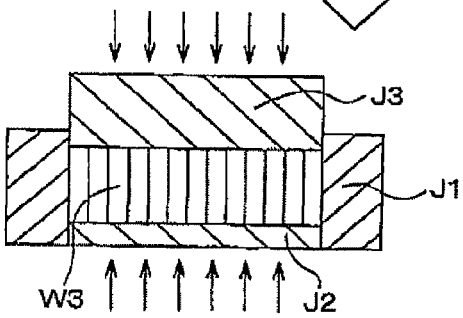
Figure 16F:
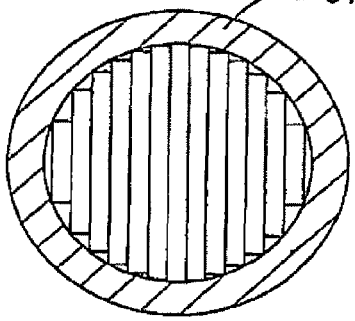

Then, as shown in FIGS. 16E and 16F, the plate-like arrangement assembly W3 is set in jigs J1, J2 and J3 and subjected to hot pressing. Thus, the strip-like materials W2 of the arrangement assembly W3 are joined to each other to obtain the plate-like wick 17.

In the wick 17 obtained in this way, the fiber layers will extend in its thickness direction. At the interface portions between the fiber layers of the wick 17, successiveness of voids will be higher than in the remaining portions (portions configuring the fiber layers). Therefore, the wick 17 has a structure in which the portions having voids of high successiveness extend in the thickness direction.

In the present embodiment, the jigs J1, J2 and J3 are formed of a stainless steel ring J1, a stainless steel circular plate J2 and a stainless steel circular column J3, respectively. Conditions for hot pressing may so preferably be, for example, 300° C. of temperature, 50 tons of applied pressure and 20 minutes of pressing time. Specifically, by performing hot pressing at a temperature that can soften the aramid fibers (thermoplastic resin) of the strip-like materials W2, the strip-like materials W2 can join to each other.

After expiration of the pressing time period, the aramid fibers are cooled in the state of being compressed with the application of a pressure to thereby reduce the size of the voids between the fibers. Further, cooling of the aramid fibers in the state of being compressed with the application of a pressure can raise the adhesion between the fibers, whereby the strength of the wick 17 can be raised.

As shown in FIG. 15C, the wick 17, when it is incorporated into the boiler unit 11, is loaded by the plate 19 and compressed. Also, the wick 17 is moistened and expanded by the working fluid 14. Thus, the size of the voids of the wick 17 is more reduced.

In the present embodiment, the outer peripheral portion of the plate 19 configures a portion of the case 15. Thus, the plate 19 is provided with a flow port 192 that allows the working fluid 14 to be sucked from the fluid-pool chamber 157*a* to the suction portion 175. In other words, the plate 19 also serves as a flow port forming member that forms the flow port 192.

The flow port 192 is formed into a groove that can communicate with the wick 17 via its front/rear surfaces. In the present embodiment, as shown by a broken line in FIG. 15A, the flow port 192 is configured by an annular groove cutting across the interface portions of the fiber layers that can be seen on the upper surface of the wick 17 (the plate surface on the side of the suction portion 175).

As shown in FIG. 14, the discharge path 21 is formed in the bottom wall portion 152 of the case 15. Specifically, in the bottom wall portion 152, the discharge path 21 is configured by the grooves 22 formed in a portion which is in contact with the wick 17. As a modification, the grooves 22 may be formed in a plate-like member provided separately from the bottom wall portion 152, and the plate-like member may be disposed between the bottom wall portion 152 and the wick 17.

The grooves 22 are formed so as to align with the through hole 172 of the wick 17. Accordingly, the through hole 172 of the wick 17 is in communication with the discharge path 21.

The pattern of the grooves 22 may be variously changed as shown in FIGS. 6A to 6D.

In the example shown in FIG. 14, a rubber seal 19*a* is disposed between the wick 17 and the plate 19 to prevent leakage of the vapor. The rubber seal 19*a* is provided with an annular groove that aligns with the flow port 192 of the plate 19. Further, in the example shown in FIG. 14, a vapor pressure port 158 is formed in a portion of the case 15, which portion is on a lateral side of the wick 17, so that a sensor for measuring vapor pressure can be connected to the vapor pressure port 158.

Also, as shown in FIG. 14, the condensation unit 13 is formed within the case 15. Specifically, the vapor discharged from the engine 121 to the low-pressure chamber 157 is condensed in the low-pressure chamber 157 and restored to the working fluid 14. As a matter of course, similar to the first embodiment, the condensation unit 13 may be formed of a vessel separate from the case 15.

In the present embodiment as well, the size of the voids in the wick 17 are made sufficiently small. Thus, the pressure $\Delta P$ of the capillary force of the wick 17 is ensured to be larger than the pressure difference (PH−PL) between the pressure PH of the high-pressure chamber 156 and the pressure PL of the low-pressure chamber 157 ($\Delta P > PH - PL$).

Therefore, the working fluid 14 collected to the fluid-pool chamber 157*a* of a low pressure is sucked from the suction portion 175 configured by the upper surface portion of the wick 17 and reaches the heat-reception portion 176 configured by the lower surface portion of the wick 17, for evaporation at the heat-reception portion 176.

According to the present embodiment, the fiber layers of the wick 17 extend from the side of the suction portion 175 toward the side of the heat-reception portion 176. Accordingly, a succession of voids is provided along and between the fiber layers from the side of the suction portion 175 toward the side of the heat-reception portion 176. In this way, flow of the working fluid 14 from the suction portion 175 to the heat-reception portion 176 will be improved, whereby supply of the working fluid 14 from the fluid-pool chamber 157*a* to the evaporation chamber 156 can be improved.

In the present embodiment, in particular, the wick 17 is formed into a plate-like shape whose thickness direction agrees with the direction in which the fiber layers extend. Therefore, the length of channels for the working fluid 14 in the wick 17 can be shortened as much as possible. Thus, since the flow of the working fluid 14 from the suction portion 175 to the heat-reception portion 176 can be more improved, the supply of the working fluid 14 from the fluid-pool chamber 157*a* to the evaporation chamber 156 can be more improved.

Further, the wick 17 is located in the heat-transfer route starting from the heating unit 3 to the fluid-pool chamber 157*a*. Thus, heat transfer from the heating unit 3 to the working fluid 14 in the fluid-pool chamber 157*a* can be suppressed by the wick 17. In this way, heat insulation properties of the fluid-pool chamber 157*a* can be improved. Resultantly, deterioration of the output efficiency can be suppressed, which deterioration would have otherwise been caused by the potential evaporation of the working fluid 14 in the fluid-pool chamber 157*a*.

The wick 17 is formed into a plate-like shape and its one plate surface (plate surface on the lower side) configures the heat-reception portion 176. Thus, it is ensured that the area of the heat-reception portion 176 of the wick 17 can be enlarged, and further heat conductivity can be improved.

The wick 17 is compressed (subjected to hot pressing) during its manufacturing process, and is loaded by the plate 19 and further compressed, when it is incorporated into the boiler unit 11. Also, the wick 17 is moistened and expanded by the working fluid 14. As a result of the compression, moistening and expansion, the voids of the wick 17 are minimized, whereby the vapor generated in the evaporation chamber 156 can be prevented from flowing back to the low-pressure chamber 157 through the voids of the wick 17. In other words, sealing properties for the vapor can be ensured.

In the present embodiment, the discharge path 21 is formed in the bottom wall portion 152 of the case 15. Thus, the vapor of the working fluid 14, which has been evaporated from the lower surface of the wick 17, reaches the through hole 172 of the wick 17 via the discharge path 21. Then, the vapor that has reached the through hole 172 of the wick 17 is discharged to the upper side of the wick 17.

Accordingly, the vapor that has evaporated from the lower surface of the wick 17 is allowed to easily escape to the upper side of the wick 17. Thus, the vapor of the working fluid 14 can be easily discharged, and further the output can be enhanced.

In addition, the vapor will be more heated when it passes through the discharge path 21, and turns to superheated vapor. As a result, vapor pressure is increased to increase the engine thrust. In other words, output energy is increased. However, increasing the scale of the discharge path 21 will decrease the heat-transfer area. Therefore, dischargeability and heat conductivity are in a trade-off relationship.

(Tenth Embodiment)

The present embodiment corresponds to the third embodiment. In the present embodiment, the configuration described in the third embodiment (i.e. the configuration shown in FIG. 7) is applied.

(Description B1)

In the ninth embodiment described above, the discharge path 21 has been configured by the grooves 22. In the present embodiment, as shown in FIG. 7, the discharge path 21 is configured by sandwiching discharge path forming members 23 between the bottom wall portion 152 of the case 15 and the wick 17.

Descriptions following the above Description B1 are the same as "Description A1" of the third embodiment. Thus, the descriptions are omitted.

In the present embodiment, advantages similar to those in the ninth embodiment can be obtained.

(Eleventh Embodiment)

The present embodiment corresponds to the fourth embodiment. In the present embodiment, the configuration described in the fourth embodiment (i.e. the configuration shown in FIGS. 8A and 8B) is applied.

(Description B2)

In the embodiments described above, the plate 19 has played a role of preventing the uplift of the center portion of the wick 17. In the present embodiment, however, as shown in FIGS. 5A and 8B, the plate 19 also plays a role of a heat-transfer plate that transfers heat from the heating unit 3 to the wick 17.

Descriptions following the above Description B2 are the same as "Description A2" of the fourth embodiment. Thus, the descriptions are omitted.

(Twelfth Embodiment)

The present embodiment corresponds to the fifth embodiment. In the present embodiment, the configuration described in the fifth embodiment (i.e. the configuration shown in FIG. 9) is applied.

(Description B3)

In the embodiments described above, the boiler unit 11 and the output unit 12 have been accommodated in the single case 15. In the present embodiment, however, as shown in FIG. 9, the boiler unit 11 is accommodated in a boiler unit case 30, while the output unit 12 and the condensation unit 13 are accommodated in a reflux unit case 31.

Descriptions following the above Description B3 are the same as "Description A3" of the fifth embodiment. Thus, the descriptions are omitted.

(Thirteenth Embodiment)

The present embodiment corresponds to the sixth embodiment. In the present embodiment, the configuration described in the sixth embodiment (i.e. the configuration shown in FIGS. 10A and 10B or 11A and 11B) is applied.

(Description B4)

Hereinafter is described a thirteenth embodiment. The present embodiment specifically exemplifies the configuration of the through hole 172 of the wick 17 of the above embodiments.

Descriptions following the above Description B4 are the same as "Description A4" of the sixth embodiment. Thus, the descriptions are omitted.

(Fourteenth Embodiment)

Figure 17A:
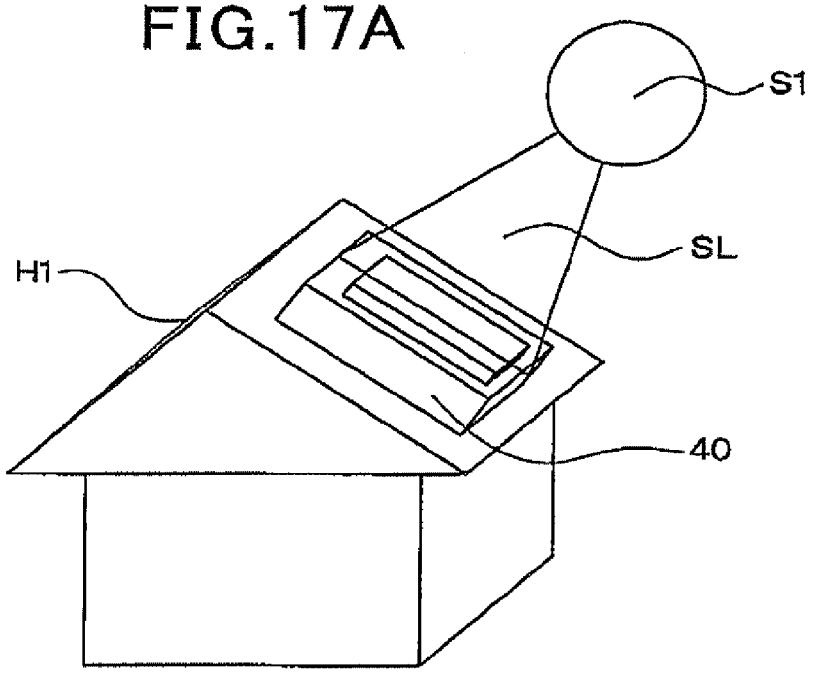
FIGS. 17 A and 17B are a perspective view and a cross-sectional view illustrating a solar-heat generator.
Figure 17B:
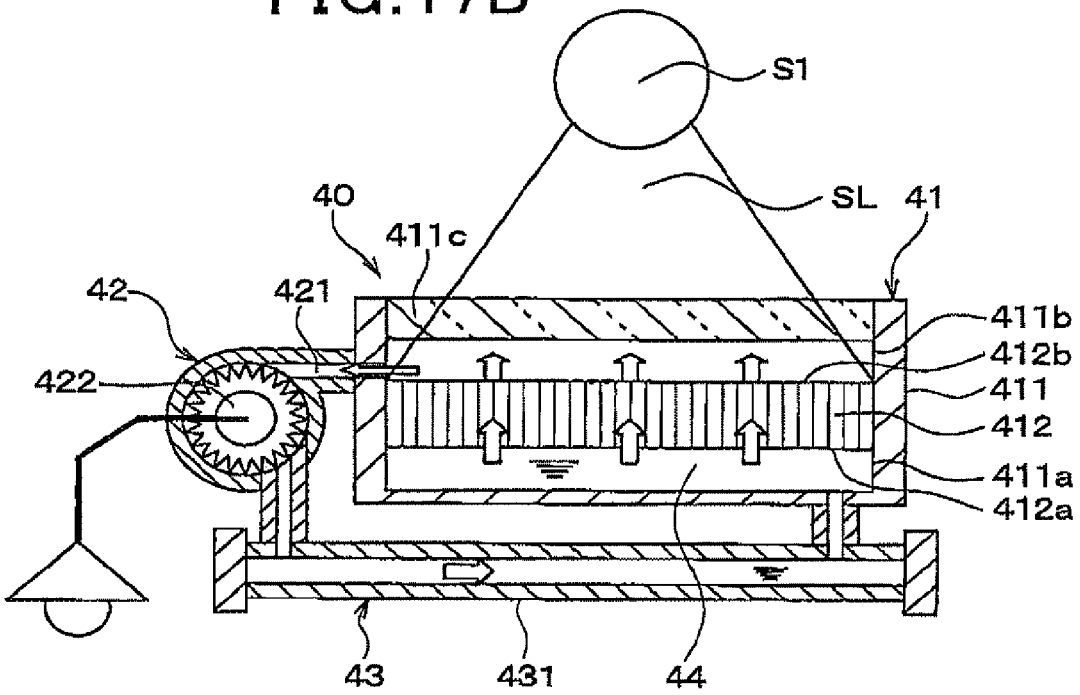

In the present embodiment, as shown in FIGS. 17A and 17B, the heat engine is applied to a solar-heat generator. A solar-heat generator 40 is located at a position, such as the roof of a residential is house H1, where light SL from the sun S1 can easily penetrate. The solar-heat generator 40 can be roughly divided into a boiler unit 41, an output unit 42 and a condensation unit 43.

(Description A5)

In the boiler unit 41, a working fluid 44 is heated by the solar heat and evaporated. The output unit 42 performs electric generation using the vapor evaporated in the boiler unit 41. The condensation unit 43 condenses the vapor that has passed through the output unit 42, for restoration to the working fluid 44. The working fluid 44 restored in the condensation unit 43 is refluxed to the boiler unit 41.

The boiler unit 41 has a case 411 that forms its housing, and a wick 412 which is located at substantially a center portion in the vertical direction in the case 411. The wick 412 defines two vertically located spaces 411*a*, 411*b* in the case 411.

In the case 411, the space 411*a* formed on the lower side of the so wick 412 configures a fluid-pool chamber for collecting the working fluid 44 refluxed from the condensation unit 43. The lower surface of the wick 412 configures a suction portion 412*a* for sucking the working fluid 44 of the fluid-pool chamber 411*a*.

In the case 411, the space 411*b* formed on the upper side of the wick 412 configures an evaporation chamber for heating and evaporating the working fluid 44 with the solar heat.

The upper surface of the case 411 is configured by a glass window 411*c* for transmitting the solar light SL. The glass window 411*c* serves as a solar light introducing portion that introduces solar light into the evaporation chamber 411*b*. The upper surface of the wick 412 configures a heat-reception portion 412*b* that receives the solar light introduced through the glass window 411*c* so as to be heated by the solar light.

The wick 412 is configured such that the pressure $\Delta P$ of the capillary force is larger than the pressure difference (PH−PL) between the pressure PH of the evaporation chamber 411*b* having a high pressure and the pressure PL of the fluid-pool chamber 411*a* having a low pressure ($\Delta P > PH - PL$). Thus, the wick 412 can suck the working fluid 44 of the fluid-pool chamber 411*a* having a low pressure using the capillary force, for supply to the evaporation chamber 411*b* having a high pressure.

In the present embodiment, the wick 412 is a fiber assembly having a plurality of fiber layers laminated one on the other. Specifically, the wick 412 is configured by a mixture of aramid fibers, i.e. thermoplastic resin fibers, and rock wool particles. Similar to the ninth embodiment described above, the fiber layers of the wick 412 each extend from the side of the suction portion 412*a* toward the side of the heat-reception portion 412*b*.

The output unit 42 includes a vapor path 421 that communicates with the evaporation chamber 411*b*, and a generator 422 that is actuated by the vapor flowed into the vapor path 421 from the evaporation chamber 411*b*. The generator 422 includes such a mechanism as a steam turbine and a pendulum-type engine with which the energy of the vapor is converted into mechanical energy. The mechanical energy converted by this mechanism is used for the electric generation.

The condensation unit 43 includes a cooler 431 that condenses the vapor which has passed through the generator 422 and restores the condensed vapor to the working fluid 44. The inner space of the cooler 431 communicates with the fluid-pool chamber 411*a* of the boiler unit 41. Thus, the working fluid 44 that has been restored by the cooler 431 is refluxed to the fluid-pool chamber 411*a* of the boiler unit 41.

According to the present embodiment, electric generation can be performed using solar energy, without using a solar battery that requires high technique and high production facilities. Accordingly, energy can be easily saved and thus clean energy can be easily realized.

(Modifications)

In the ninth to eleventh embodiments, the condensation unit 13 has been arranged on the upper side of the case 15. However, the arrangement is not limited to this, but, for example, the condensation unit 13 may be arranged beside the case 15.

Further, depending on the position of the condensation unit 13, appropriate change may be made in the specific configuration of the outflow path 151*a* for flowing out the vapor in the low-pressure chamber 157 to the condensation unit 13, and the reflux path 151*b* for refluxing the working fluid 14 condensed in the condensation unit 13 into the low-pressure chamber 157.

In the embodiments described above, the boiler unit 11 has been accommodated in a single case. Alternatively, however, the boiler unit 11 may be divided and accommodated in a plurality of cases with appropriate connection therebetween via piping. For example, the fluid-pool chamber 157*a* of the boiler unit 11 may be accommodated in a separate case and then the fluid-pool chamber 157*a* may be connected to the evaporation chamber 156 via piping. In this case, the wick 17 can be arranged in the piping connecting between the fluid-pool chamber 157*a* and the evaporation chamber 156.

In the ninth embodiment described above, the wick 17 is configured by a mixture of aramid fibers (resin fiber) and rock wool particles. However, various structures may be used as the wick 17 if only the structure includes fibers with sufficiently small voids therein and has good heat resistance.

In the ninth embodiment described above, the plate-like material W1 has been made as thin as about 4 mm, and cut into a number of strip-like materials W2 which are then juxtaposed and joined to each other to form the wick 17. However, if the plate-like material W1 has a sufficient thickness, the wick 17 can be formed by only cutting the plate-like material W1 in the array direction of the fibers.

If the plate-like material W1 is thin, it is not necessarily required to cut the material W1 into a number of strip-like materials W2, but the material W1 may be rolled up and cut into slices to form the wick 17. Alternatively, the plate-like material W1 may be fan-folded. Alternatively, long and narrow materials like paper strings may be bundled and cut to form the wick 17. In short, a fiber assembly may suffice as the wick 17 if only the fiber layers uniformly extend, like wood, in the direction perpendicular to the suction and heating planes.

In the ninth embodiment described above, the wick 17 has had a disc-like shape. However, the shape is not limited to this, but may be variously changed. For example, the wick 17 may have a triangular or square shape, or may have a shape of a serpentine column.

(Fifteenth Embodiment)

The configuration of an exhaust heat recovery apparatus of the present embodiment is based on the configuration of the exhaust heat recovery apparatus of the first embodiment.

In the present embodiment, as shown in FIG. 14, the configuration of the boiler unit 11 has been changed from the one in the first embodiment. Hereinafter are explained the changes from the first embodiment.

The fluid-pool chamber 157*a* is arranged on the upper side of the wick 17. In other words, the wick 17 is interposed between the bottom wail portion 152 of the case 15 and the fluid-pool chamber 157*a*. Thus, the wick 17 is present in the heat-transfer route starting from the heating unit 3 to the fluid-pool chamber 157*a*.

As shown in FIG. 14, the diameter of the lower portion of the cylindrical case 15 is made larger than that of the remaining portion of the case 15. The wick 17 is arranged in the lower portion of the case 15 having the enlarged diameter. The fluid-pool chamber 157*a* is formed in a portion of the case 15 on the upper side of the wick 17 (i.e. portion of the case 15 where the diameter is not enlarged).

The wick 17 is a fiber assembly (fiber-layer lamination) having a plurality of fiber layers laminated one on the other. In the present embodiment, the wick 17 is a mixture of aramid fibers, i.e. thermoplastic resin fibers, and rock wool particles.

Figure 18:
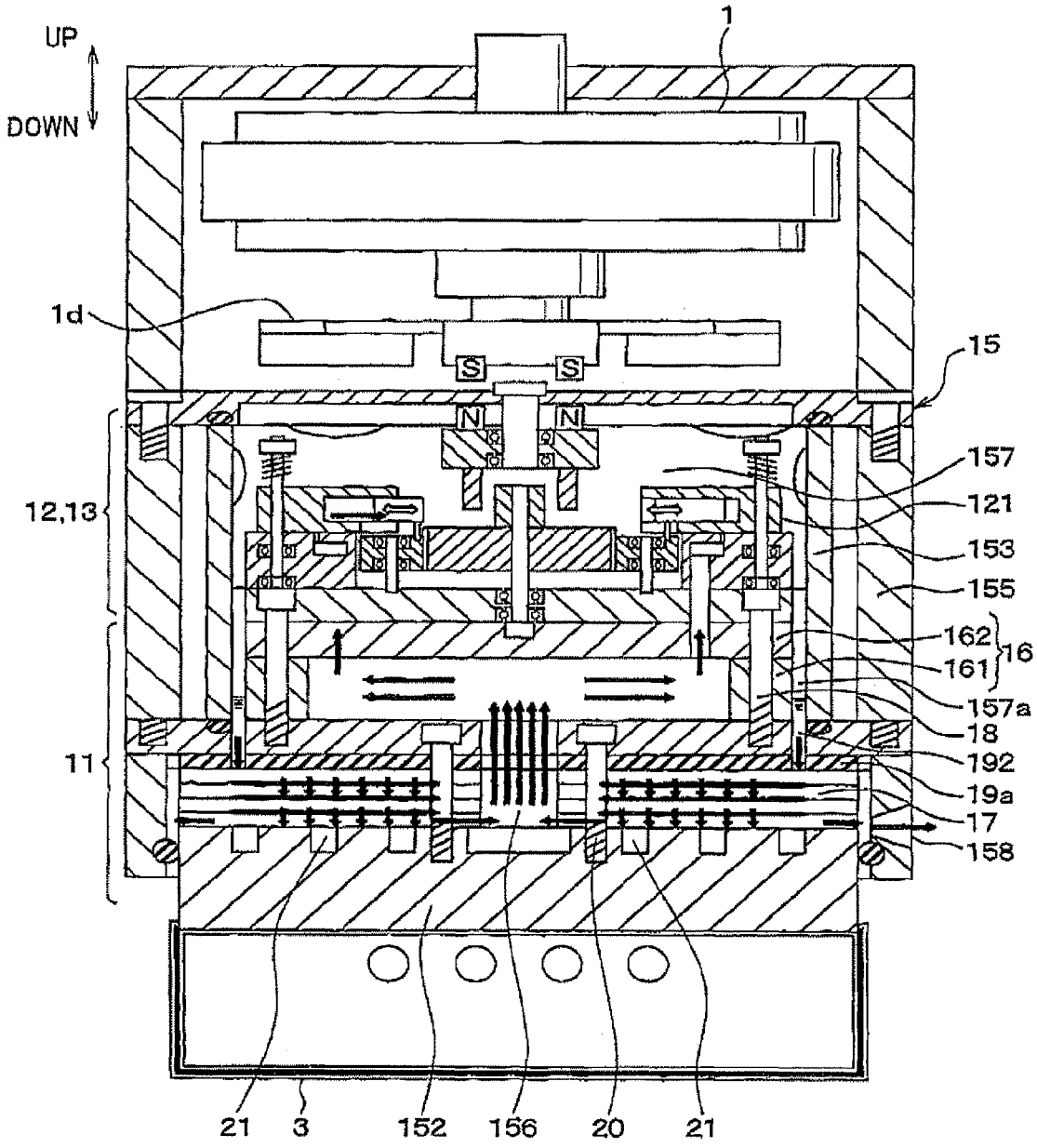
FIG. 18 is a cross-sectional view illustrating an exhaust heat recovery apparatus.
Figure 19:
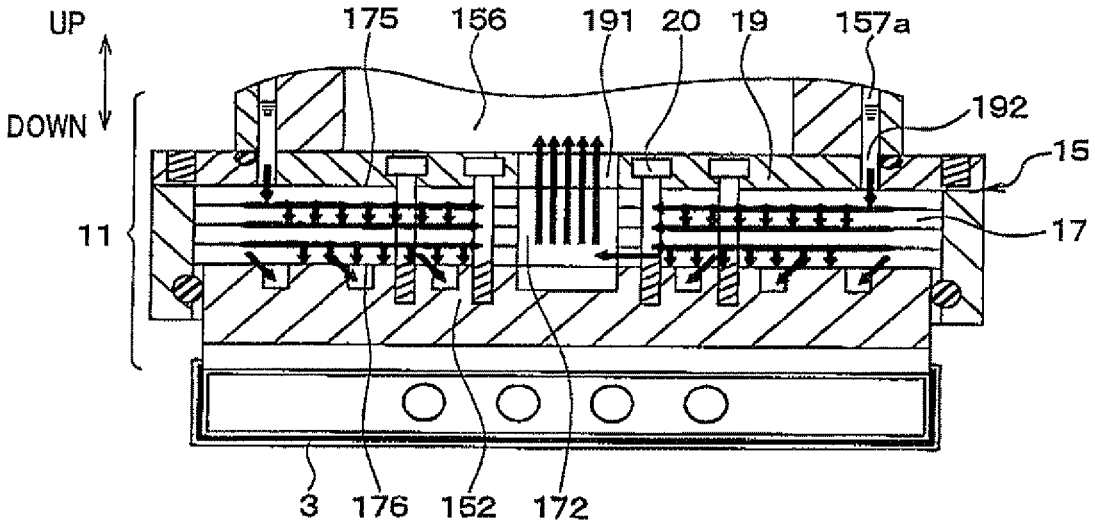
FIG. 19 is a cross-sectional view illustrating a main part of a boiler unit.

FIG. 19 is a cross-sectional view illustrating a portion in the vicinity of the wick 17 shown in FIG. 18. The wick 17 is formed by integrally joining a plurality of laminated disc-like materials. In FIG. 19, the interface portions between the disc-like materials are indicated by thin solid lines for the convenience of illustration. The plurality of disc-like materials configuring the wick 17 are laminated from the side of the suction portion 175 of the wick 17 toward the side of the heat-reception portion 176 of the wick 17.

The suction portion 175 of the wick 17 refers to a portion that sucks the working fluid 14 of the fluid-pool chamber 157*a*. The heat-reception portion 176 of the wick 17 refers to a portion that receives heat from the heating unit 3.

As shown in FIG. 18, the fluid-pool chamber 157*a* is arranged on the upper side of the evaporation chamber 156. Accordingly, the suction portion 175 of the wick 17 is configured by the upper surface so portion of the wick 17, while the heat-reception portion 176 of the wick 17 is configured by the lower surface portion of the wick 17. Thus, the plurality of disc-like materials configuring the wick 17 are laminated in the thickness direction of the wick 17.

Although not shown, the fiber layers of the wick 17 extend in a direction (horizontal direction) perpendicular to the thickness direction of the wick 17. In other words, the fiber layers of the wick 17 extend parallel to the plate surface of the wick 17.

Figure 20A:
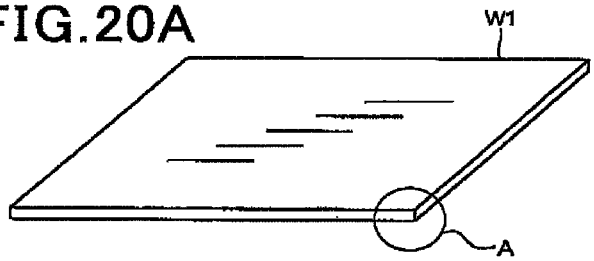
FIGS. 20A to 20E are diagrams for explaining a method of manufacturing a wick.

Referring now to FIGS. 20A to 20E, hereinafter is described a method of manufacturing such a wick 17. First, as shown in FIG. 20A, a plate-like material W1 is prepared.

The plate-like material W1 is a fiber assembly (fiber-layer lamination) having a plurality of fiber layers laminated one on the other. The material W1 is formed so as to have a predetermined thickness by repeatedly performing a paper-pressing process. In the present embodiment, the plate-like material W1 is a mixture of aramid fibers, i.e. thermoplastic resin fibers, and rock wool particles. Also, in the present embodiment, the plate-like material W1 is made as thin as about 4 mm.

Figure 20B:
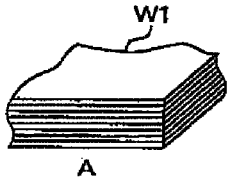

FIG. 20B is an enlarged view of FIG. 20A. In FIG. 20B, the interfaces between the fiber layers are indicated by thin solid lines for the convenience of illustration. As shown in FIG. 20B, the plurality of fiber layers configuring the plate-like material W1 are laminated in the thickness direction of the material W1. In other words, the plurality of fiber layers configuring the material W1 extend parallel to the plate surface of the material W1.

Figure 20C:
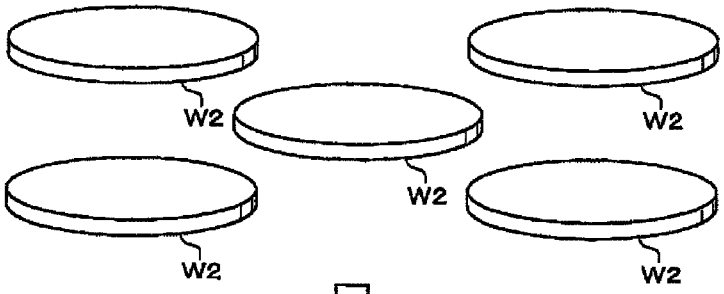

As shown in FIG. 20C, the plate-like material W1 is cut into a number of disc-like materials W2. In this case, the disc-like materials W2 are ensured to have the same outer diameter dimension.

Figure 20D:
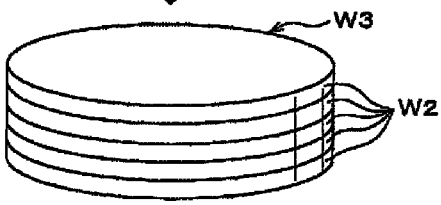

As shown in FIG. 20D, the disc-like materials W2 are laminated in the thickness direction without forming gaps therebetween to obtain a disc-like arrangement assembly W3.

In the disc-like arrangement assembly W3 obtained in this way, the fiber layers will extend in the direction perpendicular to the thickness direction of the assembly W3. In other words, the disc-like arrangement assembly W3 will have fiber layers extending in the direction parallel to the plate surface.

Figure 20E:
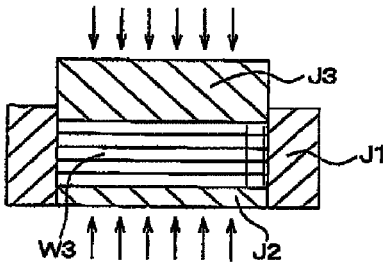

Then, as shown in FIG. 20E, the disc-like arrangement assembly W3 is set in jigs J1, J2 and J3 and subjected to hot pressing. Thus, the disc-like materials W2 of the arrangement assembly W3 join to each other to thereby obtain the disc-like wick 17.

In the wick 17 obtained in this way, the fiber layers will extend in the direction perpendicular to the thickness direction of the wick 17. At the interface portions between the fiber layers of the wick 17, the successiveness of voids will be higher than in the remaining portions (portions configuring the fiber layers).

Therefore, in the wick 17, the successiveness of voids in its thickness direction will be lower than the successiveness of voids in a direction perpendicular to the thickness direction (the direction parallel to the plate surface). Resultantly, the wick 17 will have a structure in which portions having high successiveness of voids and portions having low successiveness, of voids alternately appear in the thickness direction.

In the present embodiment, the jigs J1, J2 and J3 are formed of a stainless steel ring J1, a stainless steel circular plate J2 and a stainless steel circular column J3, respectively. Conditions for hot pressing may preferably be 300° C. of temperature, 50 tons of applied pressure and 20 minutes of pressing time period. Specifically, by performing hot pressing at a temperature that can soften the aramid fibers (thermoplastic resin) of the disc-like materials W2, the disc-like materials W2 can join to each other.

After expiration of the pressing time period, the aramid fibers are cooled in the state of being compressed with the application of a pressure to thereby reduce the size of the voids between the fibers. Further, cooling of the aramid fibers in the state of being compressed with the application of a pressure can raise the adhesion between the fibers, whereby the strength of the wick 17 can be raised.

In the present embodiment, the outer peripheral portion of the plate 19 configures a portion of the case 15. Thus, the plate 19 is provided with the flow port 192 that allows the working fluid 14 to be sucked from the fluid-pool chamber 157*a* to the suction portion 175. In other words, the plate 19 also serves as a flow port forming member that forms the flow port 192.

The flow port 192 is formed into a groove that can communicate with the wick 17 via its rear/front surfaces. In the present embodiment, the flow port 192 is configured by an annular groove concentric with the wick 17.

As shown in FIG. 18, the discharge path 21 is formed in the bottom wall portion 152 of the case 15. Specifically, in the bottom wall portion 152, the discharge path 21 is configured by the grooves 22 formed in a portion which is in contact with the wick 17. As a modification, the grooves 22 may be formed in a plate-like member provided separately from the bottom wall portion 152, and the plate-like member may be disposed between the bottom wall portion 152 and the wick 17.

The grooves 22 are formed so as to align with the through hole 172 of the wick 17. Thus, the through hole 172 of the wick 17 is in communication with the discharge path 21.

The pattern of the grooves 22 may be variously changed as shown in FIGS. 6A to 6D.

In the example shown in FIG. 14, a rubber seal 19*a* is disposed between the wick 17 and the plate 19 to prevent leakage of the vapor. The rubber seal 19*a* is provided with an annular groove that aligns with the flow port 192 of the plate 19. Further, in the example shown in FIG. 14, a vapor pressure port 158 is formed in a portion of the case 15, which portion is on a lateral side of the wick 17, so that a sensor for measuring vapor pressure can be connected to the vapor pressure port 158.

Also, as shown in FIG. 14, the condensation unit 13 is formed within the case 15. Specifically, the vapor discharged from the engine 121 to the low-pressure chamber 157 is condensed in the low-pressure chamber 157 and restored to the working fluid 14. As a matter of course, similar to the first embodiment, the condensation unit 13 may be formed of a vessel separate from the case 15.

In the present embodiment as well, the size of the voids in the wick 17 are made sufficiently small. Thus, the pressure $\Delta P$ of the capillary force of the wick 17 is ensured to be larger than the pressure difference (PH−PL) between the pressure PH of the high-pressure chamber 156 and the pressure PL of the low-pressure chamber 157 ($\Delta P > PH - PL$).

Therefore, the working fluid 14 collected to the fluid-pool chamber 157*a* of a low pressure is sucked from the suction portion 175 configured by the upper surface portion of the wick 17 and reaches the heat-reception portion 176 configured by the lower surface portion of the wick 17, for evaporation at the heat-reception portion 176.

According to the present embodiment, the fiber layers of the wick 17 are laminated from the side of the suction portion 175 toward the side of the heat-reception portion 176. Accordingly, in the wick 17, the portions having high successiveness of voids and the portions having low successiveness of voids alternately appear from the side of the suction portion 175 toward the side of the heat-reception portion 176.

Thus, since the linkage of the voids from the suction portion 175 to the heat-reception portion 176 is complicated, the vapor can be suppressed from flowing back, via the voids, from the side of the heat-reception portion 176 to the side of the suction portion 175. In addition, suppliability of the working fluid 14 from the fluid-pool chamber 157*a* to the evaporation chamber 156 can be improved.

In the present embodiment, in particular, the wick 17 is formed into a plate-like shape in which the direction of extending the fiber layers is made parallel to the direction of extending the plate surface. Accordingly, the wick 17 will have good stability in shape and good strength, and moreover, the wick 17 can be easily manufactured.

Further, the wick 17 is located in the heat-transfer route starting from the heating unit 3 to the fluid-pool chamber 157*a*. Thus, heat transfer from the heating unit 3 to the working fluid 14 in the fluid-pool chamber 157*a* can be suppressed by the wick 17. In this way, heat insulation properties of the fluid-pool chamber 157*a* can be improved. Resultantly, deterioration of the output efficiency can be suppressed, which deterioration would have otherwise been caused by the potential evaporation of the working fluid 14 in the fluid-pool chamber 157*a*.

The wick 17 is formed into a plate-like shape and its one plate surface (plate surface on the lower side) configures the heat-reception portion 176. Thus, it is ensured that the area of the heat-reception portion 176 of the wick 17 can be enlarged, and further heat conductivity can be improved.

The wick 17 is compressed (subjected to hot pressing) during its manufacturing process, and is loaded by the plate 19 and further compressed, when it is incorporated into the boiler unit 11. Also, the wick 17 is moistened and expanded by the working fluid 14. As a result of the compression, moistening and expansion, the voids of the wick 17 are minimized, whereby the vapor generated in the evaporation chamber 156 can be prevented from flowing back to the low-pressure chamber 157 through the voids of the wick 17. In other words, sealing properties for the vapor can be ensured.

In the present embodiment, the discharge path 21 is formed in the bottom wall portion 152 of the case 15. Thus, the vapor of the working fluid 14, which has been evaporated from the lower surface of the wick 17, reaches the through hole 172 of the wick 17 via the discharge path 21. Then, the vapor that has reached the through hole 172 of the wick 17 is discharged to the upper side of the wick 17.

Accordingly, the vapor that has evaporated from the lower surface of the wick 17 is allowed to easily escape to the upper side of the wick 17. Thus, the vapor of the working fluid 14 can be easily discharged, and further the output can be enhanced.

In addition, the vapor will be more heated when it passes through the discharge path 21, and turns to superheated vapor. As a result, vapor pressure is increased to increase the engine thrust. In other words, output energy is increased. However, increasing the scale of the discharge path 21 will decrease the heat-transfer area. Therefore, dischargeability and heat conductivity are in a trade-off relationship.

(Sixteenth Embodiment)

The present embodiment corresponds to the third embodiment. In the present embodiment, the configuration described in the third embodiment (i.e. the configuration shown in FIG. 7) is applied.

(Description B5)

In the fifteenth embodiment described above, the discharge path 21 has been configured by the grooves 22. In the present embodiment, as shown in FIG. 7, the discharge path 21 is configured by sandwiching discharge path forming members 23 between the bottom wall portion 152 of the case 15 and the wick 17.

Descriptions following the above Description B5 are the same as "Description A1" of the third embodiment. Thus, the descriptions are omitted.

In the present embodiment, advantages similar to those in the fifteenth embodiment can be obtained.

(Seventeenth Embodiment)

The present embodiment corresponds to the fourth embodiment. In the present embodiment, the configuration described in the fourth embodiment (i.e. the configuration shown in FIGS. 8A and 8B) is applied.

(Description B6)

In the embodiments described above, the plate 19 has played a role of preventing the uplift of the center portion of the wick 17. In the present embodiment, however, as shown in FIGS. 8A and 8B, the plate 19 also plays a role of a heat-transfer plate that transfers heat from the so heating unit 3 to the wick 17.

Descriptions following the above Description B6 are the same as "Description A2" of the fourth embodiment. Thus, the descriptions are omitted.

(Eighteenth Embodiment)

The present embodiment corresponds to the fifth embodiment. In the present embodiment, the configuration described in the fifth embodiment (i.e. the configuration shown in FIG. 9) is applied.

(Description B7)

In the embodiments described above, the boiler unit 11 and the output unit 12 have been accommodated in the single case 15. In the present embodiment, however, as shown in FIG. 9, the boiler unit 11 is accommodated in a boiler unit case 30, while the output unit 12 and the condensation unit 13 are accommodated in a reflux unit case 31.

Descriptions following the above Description B7 are the same as "Description A3" of the fifth embodiment. Thus, the descriptions are omitted.

(Nineteenth Embodiment)

The present embodiment corresponds to the sixth embodiment. In the present embodiment, the configuration described in the embodiment (i.e. the configuration shown in FIGS. 10A and 10B or 11A and 11B) is applied.

(Description B8)

Hereinafter is described a nineteenth embodiment. The present embodiment specifically exemplifies the configuration of the through hole 172 of the wick 17 of the above embodiments.

Descriptions following the above Description B8 are the same as "Description A4" of the sixth embodiment. Thus, the descriptions are omitted.

(Twentieth Embodiment)

The present embodiment corresponds to the fourteenth embodiment.

(Description B9)

Figure 21:
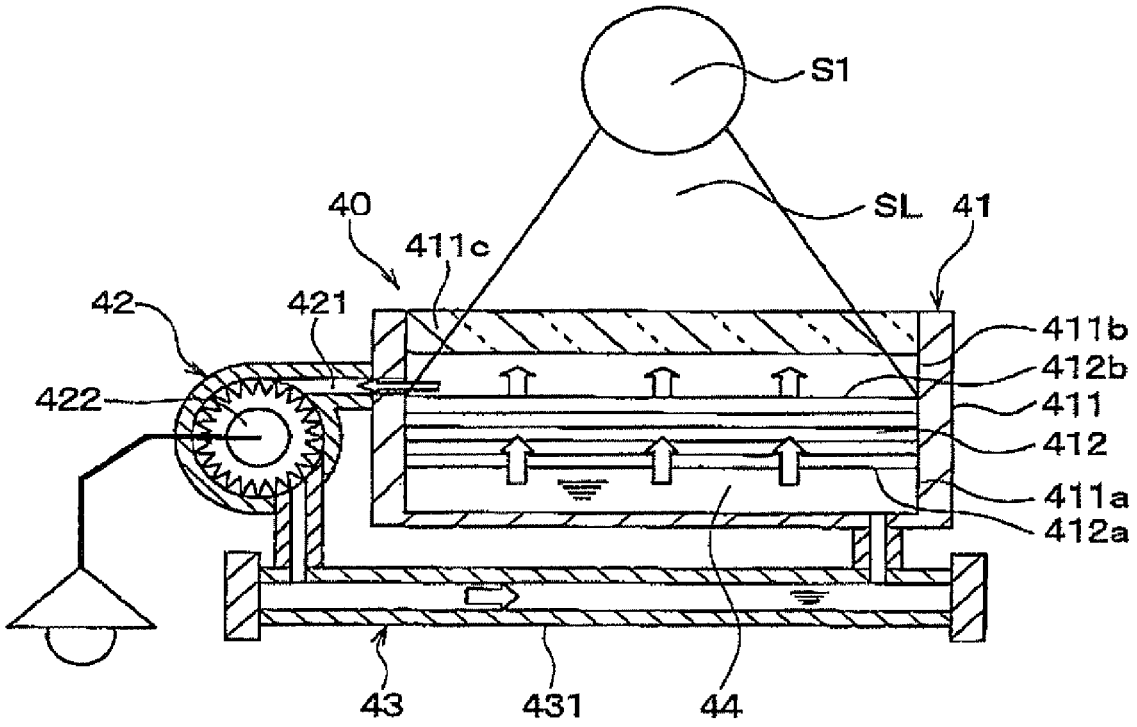
FIG. 21 is a cross-sectional view illustrating a solar-heat generator.

In the present embodiment, as shown in FIGS. 17A and 21, the heat engine is applied to a solar-heat generator. A solar-heat generator 40 is located at a position, such as the roof of a residential house H1, where light SL from the sun S1 can easily penetrate. The solar-heat generator 40 can be roughly divided into a boiler unit 41, an output unit 42 and a condensation unit 43.

Descriptions following the above Description B9 are the same as "Description A5" of the fourteenth embodiment. Thus, the descriptions are omitted. However, in the present embodiment, the description in Description A5 "In the present embodiment, the wick 412 is a fiber assembly having a plurality of fiber layers laminated one on the other. Specifically, the wick 412 is configured by a mixture of aramid fibers, i.e. thermoplastic resin fibers, and rock wool particles. Similar to the ninth embodiment described above, the fiber layers of the wick 412 each extend from the side of the suction portion 412*a* toward the side of the heat-reception portion 412*b*." is changed to "In the present embodiment, the wick 412 is a fiber assembly having a plurality of fiber layers laminated one on the other. Specifically, the wick 412 is configured by a mixture of aramid fibers, i.e. thermoplastic resin fibers, and rock wool particles. Similar to the sixteenth embodiment described above, the fiber layers of the wick 412 are laminated from the side of the suction portion 412*a* toward the side of the heat-reception portion 412*b*. That is, the wick 412 has portions having voids of different successiveness, the portions having high successiveness of voids and the portions having low successiveness of voids alternately appearing from the side of the suction portion 412*a* toward the side of the heat-reception portion 412*b*."

(Modifications)

In the fifteenth to seventeenth embodiments, the condensation unit 13 has been arranged on the upper side of the case 15. However, the arrangement is not limited to this, but, for example, the condensation unit 13 may be arranged beside the case 15.

Further, depending on the position of the condensation unit 13, appropriate change may be made in the specific configuration of the outflow path 151*a* for flowing out the vapor in the low-pressure chamber 157 to the condensation unit 13, and the reflux path 151*b* for refluxing the working fluid 14 condensed in the condensation unit 13 into the low-pressure chamber 157.

In the embodiments described above, the boiler unit 11 has been accommodated in a single case. Alternatively, however, the boiler unit 11 may be divided and accommodated in a plurality of cases with appropriate connection therebetween via piping. For example, the fluid-pool chamber 157*a* of the boiler unit 11 may be accommodated in a separate case and then the fluid-pool chamber 157*a* may be connected to the evaporation chamber 156 via piping. In this case, the wick 17 can be arranged in the piping connecting between the fluid-pool chamber 157*a* and the evaporation chamber 156.

In the fifteenth embodiment described above, the wick 17 is configured by a mixture of aramid fibers (resin fiber) and rock wool particles. However, various structures may be used as the wick 17 if only the structure includes fibers with sufficiently small voids therein and has good heat resistance.

In the fifteenth embodiment described above, the plate-like material W1 has been made as thin as about 4 mm, and cut into a number of strip-like materials W2 which are then juxtaposed and joined to each other to form the wick 17. However, if the plate-like material W1 has a sufficient thickness, the wick 17 can be formed by only cutting the plate-like material W1 in the array direction of the fibers.

In the fifteenth embodiment described above, the wick 17 has had a disc-like shape. However, the shape is not limited to this, but may be variously changed. For example, the wick 17 may have a triangular or square shape, or may have a shape of a serpentine column.

Aspects of the above-described embodiments will now be summarized.

The above embodiments provide, as one aspect,

[1-1] A heat engine, comprising:

a boiler unit (11) which includes an evaporation chamber and a fluid-pool chamber, the evaporation chamber heating a working fluid (14) by heat supplied from an external heat source (3) and generating vapor of the working fluid (14), and the fluid-pool chamber (157*a*) collecting the working fluid (14) supplied to the evaporation chamber (156);

an output unit (12) through which the vapor generated by the evaporation chamber (156) flows, and which converts energy of the vapor to mechanical energy;

a condensation unit (13) which condenses the vapor that has passed through the output unit (12), and refluxes the condensed working fluid (14) to the fluid-pool chamber (157*a*); and a working fluid guide member (17) which is disposed in the boiler unit (11), and which sucks the working fluid (14) in the fluid-pool chamber (157*a*) by using capillary force and supplies the working fluid (14) to the evaporation chamber (156), wherein the evaporation chamber (156) is separated from the fluid-pool chamber (157*a*), pressure in the evaporation chamber (156) being higher than pressure in the fluid-pool chamber (157*a*), and the working fluid guide member (17) is configured to satisfy the following expression:

$$(2\sigma/r)\cdot\cos\theta > PH - PL$$

where σ is a surface tension of the working fluid (14), r is a circle-equivalent radius of a void in the working fluid guide member (17), θ is a wetting angle of the working fluid (14) with respect to the working fluid guide member (17), PH is pressure in the evaporation chamber (156), and PL is pressure in the fluid-pool chamber (157*a*).

According to the above configuration, when the working fluid guide member (17) is configured so as to satisfy the above expression, the pressure in the working fluid guide member (17) by the capillary force becomes larger than the pressure difference between the high-pressure evaporation chamber (156) and the low-pressure fluid-pool chamber (157*a*). Thus, the supply of the working fluid (14) from the low-pressure fluid-pool chamber (157*a*) to the high-pressure evaporation chamber (156) can be performed by using the capillary force of the working fluid guide member (17). Accordingly, the working fluid (14) condensed in the condensation unit (13) can be circulated into the evaporation unit (156) having a high pressure, without using external energy as much as possible.

The above embodiments provide, as another aspect,

[1-2] The heat engine according to [1-1], wherein the boiler unit (11) includes a loading means (161) which imposes a load on the working fluid guide member (17) to reduce the size of the void in the working fluid guide member (17), and the working fluid guide member (17) is held in the boiler unit (11) in a state of being loaded by the loading means (161).

According to the above configuration, reducing the size of the void in the working fluid guide member (17) by the loading means (161) can reduce the circle-equivalent radius r of the voids in the working fluid guide member (17). Thus, the working fluid guide member (17) satisfying the above expression can be readily configured.

The above embodiments provide, as another aspect,

[1-3] The heat engine according to [1-2], wherein the boiler unit (11) includes a bulkhead (16) which defines the evaporation chamber (156) and the fluid-pool chamber (157*a*), the bulkhead (16) is disposed in the boiler unit (11) so as to impose the load on the working fluid guide member (17), and the loading means (161) is configured by the bulkhead (16).

According to the above configuration, since the bulkhead (16) defining the evaporation chamber (156) and the fluid-pool chamber (157*a*) acts as the loading means, the structure of the heat engine can so be simplified compared to the case where the bulkhead (16) and the loading means are separately provided.

The above embodiments provide, as another aspect,

[1-4] The heat engine according to [1-3], wherein the working fluid guide member (17) extends to the side of the evaporation chamber (156) with respect to the loading means (161).

According to the above configuration, the working fluid (14) of the fluid-pool chamber (157*a*) can be reliably supplied by the working fluid guide member (17) into the evaporation chamber (156).

The above embodiments provide, as another aspect,

[1-5] The heat engine according to [1-1], wherein the fluid-pool chamber (157*a*) is horizontally juxtaposed with the evaporation chamber (156), the working fluid guide member (17) is formed into a plate-like shape extending in the horizontal direction, and an end surface (171) of the working fluid guide member (17) in the horizontal direction configures an inlet through which the working fluid (14) flows from the fluid-pool chamber (157*a*).

According to the above configuration, since the working fluid guide member (17) sucks the working fluid (14) in the horizontal direction, the influence of gravity can be suppressed when the working fluid (14) is sucked by the working fluid guide member (17). Therefore, the working fluid (14) of the fluid-pool chamber (157*a*) can be reliably supplied by the working fluid guide member (17) into the evaporation chamber (156).

The above embodiments provide, as another aspect,

[1-6] The heat engine according to [1-1], wherein the boiler unit (11) includes a bottom wall portion (152) having a flat shape mounted on the external heat source (3), the evaporation chamber (156) is formed on the bottom wall portion (152), the fluid-pool chamber (157*a*) is horizontally juxtaposed with the evaporation chamber (156), the working fluid guide member (17) is formed into a plate-like shape extending in the horizontal direction and is disposed on the bottom wall portion (152), and a flat portion (173) of the working fluid guide member (17) on the side of the bottom wall portion (152) receives heat from the external heat source (3) via the bottom wall portion (152).

According to the above configuration, since the heat receiving area of the working fluid guide member (17) can be ensured to be large, the working fluid (14) sucked into the working fluid guide member (17) can be effectively heated.

The above embodiments provide, as another aspect,

[1-7] The heat engine according to [1-6], wherein an end surface (171) of the working fluid guide member (17) in the horizontal direction configures an inlet through which the working fluid (14) flows from the fluid-pool chamber (157*a*).

According to the above configuration, advantages similar to those of [1-5] can be obtained.

The above embodiments provide, as another aspect,

[1-8] The heat engine according to [1-6], wherein a portion of the working fluid guide member (17) located in the evaporation chamber (156) is formed with a through hole (172) extending in the vertical direction.

According to the above configuration, the vapor evaporated by being heated at the bottom wall portion (152) can promptly escape to the upper side of the working fluid guide member (17) from the through hole (172). Thus, it is unlikely that suction of the working fluid (14) is prevented, which would otherwise be caused by the vapor that has stayed in the working fluid guide member (17).

The above embodiments provide, as another aspect,

[1-9] The heat engine according to [1-8], wherein a heat insulating groove (152*a*) is formed at a portion of the bottom wall portion (152) located on the side of the fluid-pool chamber (157*a*) with respect to the through hole (172), the heat insulating groove (152*a*) suppressing heat transfer in the bottom wall portion (152), and a portion (152*b*) of the bottom wall portion (152) located on the side of the through hole (172) with respect to the heat insulating groove (152*a*) is mounted on the external heat source (3).

According to the above configuration, heat is easily received in a portion near the through hole (172) of the working fluid guide member (17), while heat reception is suppressed in a portion distanced from the through hole (172) of the working fluid guide member (17) (portion on the side of the fluid-pool chamber (157*a*)). As a result, the vapor generated by the heating of the bottom wall portion (152) can more promptly escape from the through hole (172) to the upper side of the working fluid guide member (17). Thus, it is more unlikely that suction of the working fluid (14) is prevented, which would otherwise be caused by the vapor that has stayed in the working fluid guide member (17) for the heating and drying of the inside of the working fluid guide member (17).

The above embodiments provide, as another aspect,

[1-10] The heat engine according to [1-1], wherein the working fluid guide member (17) is formed of a material interwoven with resin fibers.

The above embodiments provide, as one aspect,

[2-1] A heat engine, comprising:

a boiler unit (11) which includes an evaporation chamber (156, 308) and a fluid-pool chamber (157*a*, 309*a*), the evaporation chamber (156, 308) heating a working fluid (14) by heat supplied from an external heat source (3) and generating vapor of the working fluid (14), and the fluid-pool chamber (157*a*, 309*a*) collecting the working fluid (14) supplied to the evaporation chamber (156, 308);

an output unit (12) through which the vapor generated by the evaporation chamber (156, 308) flows, and which converts energy of the vapor to mechanical energy;

a condensation unit (13) which condenses the vapor that has passed through the output unit (12), and refluxes the condensed working fluid (14) to the fluid-pool chamber (157*a*, 309*a*); and a working fluid guide member (17) which is disposed in the boiler unit (11), and which sucks the working fluid (14) in the fluid-pool chamber (157*a*, 309*a*) by using capillary force and supplies the working fluid (14) to the evaporation chamber (156, 308), wherein the evaporation chamber (156, 308) is separated from the fluid-pool chamber (157*a*, 309*a*), pressure in the evaporation chamber (156, 308) being higher than pressure in the fluid-pool chamber (157*a*, 309*a*), and the working fluid guide member (17) is configured to satisfy the following expression:

$$(2\sigma/r)\cdot\cos\theta > PH - PL$$

where σ is a surface tension of the working fluid (14), r is a circle-equivalent radius of a void in the working fluid guide member (17), θ is a wetting angle of the working fluid (14) with respect to the working fluid guide member (17), PH is pressure in the evaporation chamber (156, 308), and PL is pressure in the fluid-pool chamber (157*a*, 309*a*), wherein the boiler unit (11) includes a heat-transfer member (152, 23, 302) which is thermally connected to the external heat source (3) and is in contact with the working fluid guide member (17), the working fluid guide member (17) receives heat from the external heat source (3) via the heat-transfer member (152, 23, 302), and a discharge path (21) is formed in a portion of the heat-transfer member (152, 23, 302) which is in contact with the working fluid guide member (17), the discharge path (21) discharging the vapor generated by the working fluid guide member (17).

According to the above configuration, when the working fluid guide member (17) is configured so as to satisfy the above expression, the pressure in the working fluid guide member (17) by the capillary force becomes larger than the pressure difference between the high-pressure evaporation chamber (156, 308) and the low-pressure fluid-pool chamber (157*a*, 309*a*). Thus, the supply of the working fluid (14) from the low-pressure fluid-pool chamber (157*a*, 309*a*) to the high-pressure evaporation chamber (156, 308) can be performed by using the capillary force of the working fluid guide member (17). Accordingly, the working fluid (14) condensed in the condensation unit (13) can be circulated into the evaporation unit (156, 308) having a high pressure, without using external energy as much as possible.

In addition, since the discharge path (21) is formed in a portion of the heat-transfer member (152, 23, 302) which is in contact with the working fluid guide member (17), the discharge path (21) discharging the vapor generated by the working fluid guide member (17), it is unlikely that suction of the working fluid (14) is prevented, which would otherwise be caused by the vapor that has stayed in the working fluid guide member (17).

The above embodiments provide, as another aspect,

[2-2] The heat engine according to [2-1], wherein the discharge path (21) is configured by a groove (22) formed in the heat-transfer member (152).

The above embodiments provide, as another aspect,

[2-3] The heat engine according to [2-1], wherein the heat-transfer member (152, 23) is divided into a discharge path forming member (23) configuring the discharge path (21) and a member (152) configuring a remaining portion, the discharge path forming member (23) is a mesh member or a plurality of ball-like members which are sandwiched between the member (152) configuring the remaining portion and the working fluid guide member (17), and the discharge path (21) is configured by a gap formed by the mesh member or the plurality of ball-like members.

The above embodiments provide, as another aspect,

[2-4] The heat engine according to [2-1], wherein the heat-transfer member (152, 23, 302) has an upper portion extending in the horizontal direction, the working fluid guide member (17) has a flat shape and overlaps with the upper portion of the heat-transfer member (152, 23, 302), and the working fluid guide member (17) receives heat from the external heat source (3) via the heat-transfer member (152, 23, 302).

According to the above configuration, since the heat receiving area of the working fluid guide member (17) can be ensured to be large, the working fluid (14) sucked into the working fluid guide member (17) can be effectively heated.

The above embodiments provide, as another aspect,

[2-5] The heat engine according to [2-4], wherein the boiler unit (11) has a heat-transfer plate (19) which overlaps with a surface of the working fluid guide member (17) on the opposite is side of the heat-transfer member (152, 23, 302) and transfers heat from the external heat source (3) to the working fluid guide member (17).

According to the above configuration, the working fluid guide member (17) will be heated from the side of the upper surface thereof. Therefore, the working fluid (14) is evaporated from the upper surface of the working fluid guide member (17), whereby discharge of the vapor of the working fluid (14) is enhanced, and further, the output can be improved.

The above embodiments provide, as another aspect,

[2-6] The heat engine according to [2-4], wherein an end surface (171) of the working fluid guide member (17) in the horizontal direction configures an inlet through which the working fluid (14) flows from the fluid-pool chamber (157*a*).

According to the above configuration, since the working fluid guide member (17) sucks the working fluid (14) in the horizontal direction, the influence of gravity can be suppressed when the working fluid (14) is sucked by the working fluid guide member (17). Therefore, the working fluid (14) of the fluid-pool chamber (157*a*) can be reliably supplied by the working fluid guide member (17) into the evaporation chamber (156).

The above embodiments provide, as another aspect,

[2-7] The heat engine according to [2-1], further comprising:

a boiler unit case (30) which accommodates the boiler unit (11);

a reflux unit case (31) which accommodates the output unit (12) and the condensation unit (13);

a vapor path forming portion (32) which forms a vapor path (32*a*) which allows communication between the evaporation chamber (308) of the boiler unit (11) and the output unit (12); and a circulation path forming portion (33) which forms a circulation path (33*a*) which allows communication between the condensation unit (13) and the fluid-pool chamber (309*a*) of the boiler unit (11), wherein the boiler unit case (30) and the reflux unit case (31) are disposed being distanced from each other while being connected via the vapor path forming portion (32) and the circulation path forming portion (33).

According to the above configuration, the output unit (12) and the condensation unit (13) are disposed being separated from the boiler unit (11). Accordingly, the heat of the boiler unit (11) is unlikely to be transferred to the output unit (12) and the condensation unit (13), thereby suppressing temperature rise of the output unit (12) and the condensation unit (13). Thus, condensation/reflux performance for the vapor discharged from the output unit (12) is improved.

The above embodiments provide, as another aspect,

[2-8] The heat engine according to [2-4], wherein a through hole (172) is formed in a portion of the working fluid guide member (17) positioned inside the evaporation chamber (156), the through hole (172) passing through the working fluid guide member (17).

According to the above configuration, the vapor evaporated by being heated at the heat-transfer member (152, 23, 302) can promptly escape to the upper side of the working fluid guide member (17) from the through hole (172). Thus, it is unlikely that suction of the working fluid (14) is prevented, which would otherwise be caused by the vapor that has stayed in the working fluid guide member (17).

The above embodiments provide, as another aspect,

[2-9] The heat engine according to [2-8], wherein the through hole (172) is in communication with the discharge path (21).

According to the above configuration, the vapor evaporated by being heated at the heat-transfer member (152, 23, 302) can promptly escape to the upper side of the working fluid guide member (17) from the discharge path (21) and the through hole (172). Thus, it is further unlikely that suction of the working fluid (14) is prevented, which would otherwise be caused by the vapor that has stayed in the working fluid guide member (17).

The above embodiments provide, as another aspect,

[2-10] The heat engine according to [2-8], wherein the through hole (172) is formed as a groove extending along a plate surface of the working fluid guide member (17).

The above embodiments provide, as another aspect,

[2-11] The heat engine according to [2-8], wherein the through hole (172) is provided by a large number and scattered.

The above embodiments provide, as another aspect,

[2-12] The heat engine according to [2-8], wherein the fluid-pool chamber (157*a*) is horizontally juxtaposed with the through hole (172), a heat insulating groove (152*a*) is formed at a portion of the heat-transfer member (152), which portion is on the side of the fluid-pool chamber (157*a*) with respect to the through hole (172), and a portion of the heat-transfer member (152), which portion is on the side of the through hole (172) with respect to the heat insulating groove (152*a*), receives heat from the external heat source (3).

According to the above configuration, heat is well received in a portion near the through hole (172) of the working fluid guide member (17), while heat reception is suppressed in a portion distanced from the through hole (172) of the working fluid guide member (17) (portion on the side of the fluid-pool chamber (157*a*)). As a result, the vapor generated by the heating of the heat-transfer member (152) can more promptly escape from the through hole (172) to the upper side of the working fluid guide member (17). Thus, it is more unlikely that suction of the working fluid (14) is prevented, which would otherwise be caused by the vapor that has stayed in the working fluid guide member (17) for the heating and drying of the inside of the working fluid guide member (17).

The above embodiments provide, as another aspect,

[2-13] The heat engine according to [2-1], wherein the boiler unit (11) includes a loading means (161) which impose a load on the working fluid guide member (17) to reduce the size of the void in the working fluid guide member (17), and the working fluid guide member (17) is held in the boiler unit (11) in a state of being loaded by the loading means (161).

According to the above configuration, reducing the size of the void in the working fluid guide member (17) by the loading means (161) can reduce the circle-equivalent radius r of the voids in the working fluid guide member (17). Thus, the working fluid guide member (17) satisfying the above expression can be readily configured.

The above embodiments provide, as another aspect,

[2-14] The heat engine according to [2-13], wherein the boiler unit (11) includes a bulkhead (16) which defines the evaporation chamber (156) and the fluid-pool chamber (157*a*), the bulkhead (16) is disposed in the boiler unit (11) so as to impose the load on the working fluid guide member (17), and the loading means (161) is configured by the bulkhead (16).

According to the above configuration, since the bulkhead (16) defining the evaporation chamber (156) and the fluid-pool chamber (157*a*) acts as the loading means, the structure of the heat engine can be simplified compared to the case where the bulkhead (16) and the loading means are separately provided.

The above embodiments provide, as another aspect,

[2-15] The heat engine according to [2-14], wherein the working fluid guide member (17) extends to the side of the evaporation chamber (156) with respect to the loading means (161).

According to the above configuration, the working fluid (14) of the fluid-pool chamber (157*a*) can be reliably supplied by the working fluid guide member (17) into the evaporation chamber (156).

The above embodiments provide, as another aspect,

[2-16] The heat engine according to (2-1), wherein the working fluid guide member (17) is formed of a material interwoven with resin fibers.

The above embodiments provide, as one aspect,

[3-1] A heat engine, comprising:

a boiler unit (11) which includes an evaporation chamber (156, 308) and a fluid-pool chamber (157*a*, 309*a*), the evaporation chamber (156, 308) heating a working fluid (14) by heat supplied from an external heat source (3) and generating vapor of the working fluid (14), and the fluid-pool chamber (157*a*, 309*a*) collecting the working fluid (14) supplied to the evaporation chamber (156, 308);

an output unit (12) through which the vapor generated by the evaporation chamber (156, 308) flows, and which converts energy of the vapor to mechanical energy;

a condensation unit (13) which condenses the vapor that has passed through the output unit (12), and refluxes the condensed working fluid (14) to the fluid-pool chamber (157*a*, 309*a*); and a working fluid guide member (17) which is disposed in the boiler unit (11), and which sucks the working fluid (14) in the fluid-pool chamber (157*a*, 309*a*) by using capillary force and supplies the working fluid (14) to the evaporation chamber (156, 308), wherein the evaporation chamber (156, 308) is separated from the fluid-pool chamber (157*a*, 309*a*), pressure in the evaporation chamber (156, 308) being higher than pressure in the fluid-pool chamber (157*a*, 309*a*), and the working fluid guide member (17) is configured to satisfy the following expression:

$$(2\sigma/r)\cdot\cos\theta > PH - PL$$

where σ is a surface tension of the working fluid (14), r is a circle-equivalent radius of a void in the working fluid guide member (17), θ is a wetting angle of the working fluid (14) with respect to the working fluid guide member (17), PH is pressure in the evaporation chamber (156, 308), and PL is pressure in the fluid-pool chamber (157*a*, 309*a*).

According to the above configuration, when the working fluid guide member (17) is configured so as to satisfy the above expression, the pressure in the working fluid guide member (17) by the capillary force becomes larger than the pressure difference between the high-pressure evaporation chamber (156, 308) and the low-pressure fluid-pool chamber (157*a*, 309*a*). Thus, the supply of the working fluid (14) from the low-pressure fluid-pool chamber (157*a*, 309*a*) to the high-pressure evaporation chamber (156, 308) can be performed by using the capillary force of the working fluid guide member (17). Accordingly, the working fluid (14) condensed in the condensation unit (13) can be circulated into the evaporation unit (156, 308) having a high pressure, without using external energy as much as possible.

The above embodiments provide, as another aspect,

[3-2] The heat engine according to [3-1], wherein the working fluid guide member (17) includes a suction portion so (175) which sucks the working fluid (14) of the fluid-pool chamber (157*a*, 309*a*) and a heat-reception portion (176) which receives heat from the external heat source (3), and the working fluid guide member (17) has portions having voids of different successiveness, the voids of high successiveness extending from the side of the suction portion (175) to the side of the heat-reception portion (176).

According to the above configuration, since the voids of high successiveness extend from the side of the suction portion (175) to the side of the heat-reception portion (176), flowability of the working fluid (14) from the suction portion (175) to the heat-reception portion (176) can be improved. Accordingly, suppliability of the working fluid (14) from the fluid-pool chamber (157*a*, 309*a*) to the evaporation chamber (156, 308) can be improved.

The above embodiments provide, as another aspect,

[3-3] The heat engine according [3-2], wherein the working fluid guide member (17) has a laminated structure of a plurality of fiber layers, the plurality of fiber layers extend from the side of the suction portion (175) toward the side of the heat-reception portion (176), and the portion having voids of high successiveness is an interface portion between the fiber layers.

In particular, fibers configuring the fiber layers of the working fluid guide member (17) are preferably thermoplastic resin fibers (more particularly, aramid fibers).

The above embodiments provide, as another aspect,

[3-4] The heat engine according to [3-3], wherein the working fluid guide member (17) has a plate-like shape whose thickness direction is the direction in which the fiber layers extend, the suction portion (175) is configured by one plate surface of the working fluid guide member (17), and the heat-reception portion (176) is configured by the other plate surface of the working fluid guide member (17).

According to the above configuration, since the path for the working fluid (14) in the working fluid guide member (17) can be shortened, suppliability of the working fluid (14) can be improved. In addition, since the area of the heat-reception portion (176) can be enlarged, heat conductivity can be improved.

The above embodiments provide, as another aspect,

[3-5] The heat engine according to [3-4], further comprising a flow port forming member (19) which is disposed opposite the plate surface of the working fluid guide member (17) on the side of the suction portion (175) and forms a flow port (192) that allows the working fluid (14) to be sucked from the fluid-pool chamber (157*a*, 309*a*) to the suction portion (175), wherein the flow port (192) is configured by a groove cutting across the interface portion which is seen on the plate surface of the working fluid guide member (17) on the side of the suction portion (175).

According to the above configuration, since the working fluid (14) of the fluid-pool chamber (157*a*, 309*a*) can be properly distributed to a plurality of interface portions, suppliability of the working fluid (14) can be further improved.

The above embodiments provide, as another aspect,

[3-6] The heat engine according to [3-1], wherein the working fluid guide member (17) is located in a heat-transfer route starting from the external heat source (3) to the fluid-pool chamber (157*a*, 309*a*) to suppress heat transfer from the external heat source (3) to the fluid-pool chamber (157*a*, 309*a*).

According to the above configuration, since heat insulation properties of the fluid-pool chamber (157*a*, 309*a*) can be improved, deterioration of the output efficiency can be suppressed, which deterioration would have otherwise been caused by the potential evaporation of the working fluid (14) in the fluid-pool chamber (157*a*, 309*a*).

The above embodiments provide, as another aspect,

[3-7] The heat engine according to [3-1], wherein the boiler unit (11) includes a heat-transfer member (152, 23, 302) which is in contact with the heat-reception portion (176) of the working fluid guide member (17) and transfers heat from the external heat source (3) to the working fluid guide member (17), and a discharge path (21) is formed in a portion of the heat-transfer member (152, 23, 302) which is in contact with the heat-reception portion (176), the discharge path (21) discharging the vapor generated by the working fluid guide member (17).

According to the above configuration, since the discharge path (21) is formed in a portion of the heat-transfer member (152, 23, 302) which is in contact with the heat-reception portion (176), the discharge path (21) discharging the vapor generated by the working fluid guide member (17), it is unlikely that suction of the working fluid (14) is prevented, which would otherwise be caused by the vapor that has stayed in the working fluid guide member (17).

The above embodiments provide, as another aspect,

[3-8] The heat engine according to [3-7], wherein the discharge path (21) is configured by a groove (22) formed in the heat-transfer member (152).

The above embodiments provide, as another aspect,

[3-9] The heat engine according to [3-7], wherein the heat-transfer member (152, 23) is divided into a discharge path forming member (23) configuring the discharge path (21) and a member (152) configuring a remaining portion, the discharge path forming member (23) is a mesh member or a plurality of ball-like members which are sandwiched between the member (152) configuring the remaining portion and the working fluid guide member (17), and the discharge path (21) is configured by a gap formed by the mesh member or the plurality of ball-like members.

The above embodiments provide, as another aspect,

[3-10] The heat engine according to [3-7], wherein the heat-transfer member (152, 23, 302) has an upper portion extending in the horizontal direction, the working fluid guide member (17) has a flat shape and overlaps with the upper portion of the heat-transfer member (152, 23, 302), and the working fluid guide member (17) receives heat from the external heat source (3) via the heat-transfer member (152, 23, 302).

According to the above configuration, since the heat receiving area of the working fluid guide member (17) can be ensured to be large, the working fluid (14) sucked into the working fluid guide member (17) can be effectively heated.

The above embodiments provide, as another aspect,

[3-11] The heat engine according to [3-10], wherein the boiler unit (11) has a heat-transfer plate (19) which overlaps with a surface of the working fluid guide member (17) on the opposite side of the heat-transfer member (152, 23, 302) and transfers heat from the external heat source (3) to the working fluid guide member (17).

According to the above configuration, the working fluid guide member (17) will be heated from the side of the upper surface thereof. Therefore, the working fluid (14) is evaporated from the upper surface of the working fluid guide member (17), whereby discharge of the vapor of the working fluid (14) is enhanced, and further, the output can be improved.

The above embodiments provide, as another aspect,

[3-12] The heat engine according to [3-1], further comprising:

a boiler unit case (30) which accommodates the boiler unit (11);

a reflux unit case (31) which accommodates the output unit (12) and the condensation unit (13);

a vapor path forming portion (32) which forms a vapor path (32*a*) which allows communication between the evaporation chamber (308) of the boiler unit (11) and the output unit (12); and a circulation path forming portion (33) which forms a circulation path (33*a*) which allows communication between the condensation unit (13) and the fluid-pool chamber (309*a*) of the boiler unit (11), wherein the boiler unit case (30) and the reflux unit case (31) are disposed being distanced from each other while being connected via the vapor path forming portion (32) and the circulation path forming portion (33).

According to the above configuration, the output unit (12) and the condensation unit (13) are disposed being separated from the boiler unit (11). Accordingly, the heat of the boiler unit (11) is unlikely to be transferred to the output unit (12) and the condensation unit (13), thereby suppressing temperature rise of the output unit (12) and the condensation unit (13). Thus, condensation/reflux performance for the vapor discharged from the output unit (12) is improved.

The above embodiments provide, as another aspect,

[3-13] The heat engine according to [3-10], wherein a through hole (172) is formed in a portion of the working fluid guide member (17) positioned inside the evaporation chamber (156), the through hole (172) passing through the working fluid guide member (17).

According to the above configuration, the vapor evaporated by being heated at the heat-transfer member (152, 23, 302) can promptly escape to the upper side of the working fluid guide member (17) from the through hole (172). Thus, it is unlikely that suction of the working fluid (14) is prevented, which would otherwise be caused by the vapor that has stayed in the working fluid guide member (17).

The above embodiments provide, as another aspect,

[3-14] The heat engine according to [3-13], wherein the through hole (172) is in communication with the discharge path (21).

According to the above configuration, the vapor evaporated by being heated at the heat-transfer member (152, 23, 302) can promptly escape to the upper side of the working fluid guide member (17) from the discharge path (21) and the through hole (172). Thus, it is further unlikely that suction of the working fluid (14) is prevented, which would otherwise be caused by the vapor that has stayed in the working fluid guide member (17).

The above embodiments provide, as another aspect,

[3-15] The heat engine according to [3-13], wherein the through hole (172) is formed as a groove extending along a plate surface of the working fluid guide member (17).

The above embodiments provide, as another aspect,

[3-16] The heat engine according to [3-13], wherein the through hole (172) is provided by a large number and scattered.

The above embodiments provide, as another aspect,

[3-17] The heat engine according to [3-1], wherein the boiler unit (11) includes a loading means (161) which impose a load on the working fluid guide member (17) to reduce the size of the void in the working fluid guide member (17), and the working fluid guide member (17) is held in the boiler unit (11) in a state of being loaded by the loading means (161).

According to the above configuration, reducing the size of the void in the working fluid guide member (17) by the loading means (161) can reduce the circle-equivalent radius r of the voids in the working fluid guide member (17). Thus, the working fluid guide member (17) satisfying the above expression can be readily configured.

The above embodiments provide, as another aspect,

[3-18] The heat engine according to [3-17], wherein the boiler unit (11) includes a bulkhead (16) which defines the evaporation chamber (156) and the fluid-pool chamber (157*a*), the bulkhead (16) is disposed in the boiler unit (11) so as to impose the load on the working fluid guide member (17), and the loading means (161) is configured by the bulkhead (16).

According to the above configuration, since the bulkhead (16) defining the evaporation chamber (156) and the fluid-pool chamber (157*a*) acts as the loading means, the structure of the heat engine can be simplified compared to the case where the bulkhead (16) and the loading means are separately provided.

The above embodiments provide, as another aspect,

[3-19] The heat engine according to [3-1], wherein the working fluid guide member (17) is formed of a material interwoven with resin fibers.

The above embodiments provide, as another aspect,

[3-20] A heat engine, comprising:

a boiler unit (41) which includes an evaporation chamber (411*b*) and a fluid-pool chamber (411*a*), the evaporation chamber (411*b*) heating a working fluid (44) by heat obtained from solar light and generating vapor, and the fluid-pool chamber (411*a*) collecting the working fluid (44) supplied to the evaporation chamber (411*b*);

an output unit (42) through which the vapor generated by the evaporation chamber (411*b*) flows, and which converts energy of the vapor to mechanical energy;

a condensation unit (43) which condenses the vapor that has passed through the output unit (42), and refluxes the condensed working fluid (44) to the fluid-pool chamber (411*a*); and a working fluid guide member (412) which is disposed in the boiler unit (41), and which sucks the working fluid (44) in the fluid-pool chamber (411*a*) by using capillary force and supplies the working fluid (44) to the evaporation chamber (411*b*), wherein the evaporation chamber (411*b*) is separated from the fluid-pool chamber (411*a*), pressure in the evaporation chamber (411*b*) being higher than pressure in the fluid-pool chamber (411*a*), the working fluid guide member (412) is configured to satisfy the following expression:

$$(2\sigma/r)\cdot\cos\theta > PH - PL$$

where σ is a surface tension of the working fluid (44), r is a circle-equivalent radius of a void in the working fluid guide member (412), θ is a wetting angle of the working fluid (44) with respect to the working fluid guide member (412), PH is pressure in the evaporation chamber (411*b*), and PL is pressure in the fluid-pool chamber (411*a*), the boiler unit (41) includes a solar fight introducing portion (411*c*) which introduces the solar light into the evaporation chamber (411*b*), and the working fluid guide member (412) includes a heat-reception portion (412*b*) which receives the solar light introduced through the solar light introducing portion (411*c*) so as to be heated by the solar light.

According to the above configuration, in the heat engine in which mechanical energy is obtained from solar light, the working fluid (14) condensed in the condensation unit (13) can be circulated into the evaporation unit (156, 308) having a high pressure without using external energy as much as possible. Accordingly, energy can be saved and thus clean energy can be realized.

The above embodiments provide, as one aspect,

[4-1] A heat engine, comprising:

a boiler unit (11) which includes an evaporation chamber (156, 308) and a fluid-pool chamber (157*a*, 309*a*), the evaporation chamber (156, 308) heating a working fluid (14) by heat supplied from an external heat source (3) and generating vapor of the working fluid (14), and the fluid-pool chamber (157*a*, 309*a*) collecting the working fluid (14) supplied to the evaporation chamber (156, 308);

an output unit (12) through which the vapor generated by the evaporation chamber (156, 308) flows, and which converts energy of the vapor to mechanical energy;

a condensation unit (13) which condenses the vapor that has passed through the output unit (12), and refluxes the condensed working fluid (14) to the fluid-pool chamber (157*a*, 309*a*); and a working fluid guide member (17) which is disposed in the boiler unit (11), and which sucks the working fluid (14) in the fluid-pool chamber (157*a*, 309*a*) by using capillary force and supplies the working fluid (14) to the evaporation chamber (156, 308), wherein the evaporation chamber (156, 308) is separated from the fluid-pool chamber (157*a*, 309*a*), pressure in the evaporation chamber (156, 308) being higher than pressure in the fluid-pool chamber (157*a*, 309*a*), the working fluid guide member (17) is configured to satisfy the following expression:

$$(2\sigma/r)\cdot\cos\theta > PH - PL$$

where σ is a surface tension of the working fluid (14), r is a circle-equivalent radius of a void in the working fluid guide member (17), θ is a wetting angle of the working fluid (14) with respect to the working fluid guide member (17), PH is pressure in the evaporation chamber (156, 308), and PL is pressure in the fluid-pool chamber (157*a*, 309*a*), the working fluid guide member (17) includes a suction portion (175) which sucks the working fluid (14) of the fluid-pool chamber (157*a*, 309*a*) and a heat-reception portion (176) which receives heat from the external heat source (3), and the working fluid guide member (17) has portions having voids of different successiveness, the portions having high successiveness of voids and the portions having low successiveness of voids alternately appearing from the side of the suction portion (175) toward the side of the heat-reception portion (176).

According to the above configuration, when the working fluid guide member (17) is configured so as to satisfy the above expression, the pressure in the working fluid guide member (17) by the capillary force becomes larger than the pressure difference between the high-pressure evaporation chamber (156, 308) and the low-pressure fluid-pool chamber (157*a*, 309*a*). Thus, the supply of the working fluid (14) from the low-pressure fluid-pool chamber (157*a*, 309*a*) to the high-pressure evaporation chamber (156, 308) can be performed by using the capillary force of the working fluid guide member (17). Accordingly, the working fluid (14) condensed in the condensation unit (13) can be circulated into the evaporation unit (156, 308) having a high pressure, without using external energy as much as possible.

In addition, the working fluid guide member (17) has portions having voids of different successiveness, the portions having high successiveness of voids and the portions having low successiveness of voids alternately appearing from the side of the suction portion (175) toward the side of the heat-reception portion (176). Thus, the vapor can be suppressed from flowing back, via the voids, from the side of the heat-reception portion (176) to the side of the suction portion (175). Accordingly, the vapor can be properly sealed. In addition, suppliability of the working fluid (14) from the fluid-pool chamber (157*a*, 309*a*) to the evaporation chamber (156, 308) can be improved.

The above embodiments provide, as another aspect,

[4-2] The heat engine according to [4-1], wherein the working fluid guide member (17) has a laminated structure of a plurality of fiber layers, the plurality of fiber layers are laminated from the side of the suction portion (175) toward the side of the heat-reception portion (176), and the portion having the voids of high successiveness is an interface portion between the fiber layers, and the portion having the voids of low successiveness configures the fiber layer.

In particular, fibers configuring the fiber layers of the working fluid guide member (17) are preferably thermoplastic resin fibers (more particularly, aramid fibers).

The above embodiments provide, as another aspect,

[4-3] The heat engine according to [4-2], wherein the working fluid guide member (17) has a plate-like shape which extends in the direction parallel to the direction in which the fiber layers extend, the suction portion (175) is configured by one plate surface of the working fluid guide member (17), and the heat-reception portion (176) is configured by the other plate surface of the working fluid guide member (17).

According to the above configuration, the working fluid guide member (17) can have good stability in shape and good strength. In addition, the working fluid guide member (17) can be easily manufactured.

The above embodiments provide, as another aspect,

[4-4] The heat engine according to [4-1], wherein the working fluid guide member (17) is located in a heat-transfer route starting from the external heat source (3) to the fluid-pool chamber (157*a*, 309*a*) to suppress heat transfer from the external heat source (3) to the fluid-pool chamber (157*a*, 309*a*).

According to the above configuration, since heat insulation properties of the fluid-pool chamber (157*a*, 309*a*) can be improved, deterioration of the output efficiency can be suppressed, which deterioration would have otherwise been caused by the potential evaporation of the working fluid (14) in the fluid-pool chamber (157*a*, 309*a*).

The above embodiments provide, as another aspect,

[4-5] The heat engine according to [4-1], wherein the boiler unit (11) includes a heat-transfer member (152, 23, 302) which is in contact with the heat-reception portion (176) of the working fluid guide member (17) and transfers heat from the external heat source (3) to the working fluid guide member (17), and a discharge path (21) is formed in a portion of the heat-transfer member (152, 23, 302) which is in contact with the heat-reception portion (176), the discharge path (21) discharging the vapor generated by the working fluid guide member (17).

According to the above configuration, since the discharge path (21) is formed in a portion of the heat-transfer member (152, 23, 302) which is in contact with the heat-reception portion (176), the discharge path (21) discharging the vapor generated by the working fluid guide member (17), it is unlikely that suction of the working fluid (14) is prevented, which would otherwise be caused by the vapor that has stayed in the working fluid guide member (17).

The above embodiments provide, as another aspect,

[4-6] The heat engine according to [4-5], wherein the discharge path (21) is configured by a groove (22) formed in the heat-transfer member (152).

The above embodiments provide, as another aspect,

[4-7] The heat engine according to [4-5], wherein the heat-transfer member (152, 23) is divided into a discharge path forming member (23) configuring the discharge path (21) and a member (152) configuring a remaining portion, the discharge path forming member (23) is a mesh member or a plurality of ball-like members which are sandwiched between the is member (152) configuring the remaining portion and the working fluid guide member (17), and the discharge path (21) is configured by a gap formed by the mesh member or the plurality of ball-like members.

The above embodiments provide, as another aspect,

[4-8] The heat engine according to [4-5], wherein the heat-transfer member (152, 23, 302) has an upper portion extending in the horizontal direction, the working fluid guide member (17) has a flat shape and overlaps with the upper portion of the heat-transfer member (152, 23, 302), and the working fluid guide member (17) receives heat from the external heat source (3) via the heat-transfer member (152, 23, 302).

According to the above configuration, since the heat receiving area of the working fluid guide member (17) can be ensured to be large, the working fluid (14) sucked into the working fluid guide member (17) can be effectively heated.

The above embodiments provide, as another aspect,

[4-9] The heat engine according to [4-8], wherein the boiler unit (11) has a heat-transfer plate (19) which overlaps with a surface of the working fluid guide member (17) on the opposite side of the heat-transfer member (152, 23, 302) and transfers heat from the external heat source (3) to the working fluid guide member (17).

According to the above configuration, the working fluid guide member (17) will be heated from the side of the upper surface thereof. Therefore, the working fluid (14) is evaporated from the upper surface of the working fluid guide member (17), whereby discharge of the vapor of the working fluid (14) is enhanced, and further, the output can be improved.

The above embodiments provide, as another aspect,

[4-10] The heat engine according to [4-1], further comprising:

a boiler unit case (30) which accommodates the boiler unit (11);

a reflux unit case (31) which accommodates the output unit (12) and the condensation unit (13);

a vapor path forming portion (32) which forms a vapor path (32*a*) which allows communication between the evaporation chamber (308) of the boiler unit (11) and the output unit (12); and a circulation path forming portion (33) which forms a circulation path (33*a*) which allows communication between the condensation unit (13) and the fluid-pool chamber (309*a*) of the boiler unit (11), wherein the boiler unit case (30) and the reflux unit case (31) are disposed being distanced from each other while being connected via the vapor path forming portion (32) and the circulation path forming portion (33).

According to the above configuration, the output unit (12) and the condensation unit (13) are disposed being separated from the boiler unit (11). Accordingly, the heat of the boiler unit (11) is unlikely to be transferred to the output unit (12) and the condensation unit (13), so thereby suppressing temperature rise of the output unit (12) and the condensation unit (13). Thus, condensation/reflux performance for the vapor discharged from the output unit (12) is improved.

The above embodiments provide, as another aspect,

[4-11] The heat engine according to [4-8], wherein a through hole (172) is formed in a portion of the working fluid guide member (17) positioned inside the evaporation chamber (156), the through hole (172) passing through the working fluid guide member (17).

According to the above configuration, the vapor evaporated by being heated at the heat-transfer member (152, 23, 302) can promptly escape to the upper side of the working fluid guide member (17) from the through hole (172). Thus, it is unlikely that suction of the working fluid (14) is prevented, which would otherwise be caused by the vapor that has stayed in the working fluid guide member (17).

The above embodiments provide, as another aspect,

[4-12] The heat engine according to [4-11], wherein the through hole (172) is in communication with the discharge path (21).

According to the above configuration, the vapor evaporated by being heated at the heat-transfer member (152, 23, 302) can promptly escape to the upper side of the working fluid guide member (17) from the discharge path (21) and the through hole (172). Thus, it is further unlikely that suction of the working fluid (14) is prevented, which would otherwise be caused by the vapor that has stayed in the working fluid guide member (17).

The above embodiments provide, as another aspect,

[4-13] The heat engine according to [4-11], wherein the through hole (172) is formed as a groove extending along a plate surface of the working fluid guide member (17).

The above embodiments provide, as another aspect,

[4-14] The heat engine according to [4-11], wherein the through hole (172) is provided by a large number and scattered.

The above embodiments provide, as another aspect,

[4-15] The heat engine according to [4-1], wherein the boiler unit (11) includes a loading means (161) which impose a load on the working fluid guide member (17) to reduce the size of the void in the working fluid guide member (17), and the working fluid guide member (17) is held in the boiler unit (11) in a state of being loaded by the loading means (161).

According to the above configuration, reducing the size of the void in the working fluid guide member (17) by the loading means (161) can reduce the circle-equivalent radius r of the voids in the working fluid guide member (17). Thus, the working fluid guide member (17) satisfying the above expression can be readily configured.

The above embodiments provide, as another aspect,

[4-16] The heat engine according to [4-17] wherein the boiler unit (11) includes a bulkhead (16) which defines the evaporation chamber (156) and the fluid-pool chamber (157*a*), the bulkhead (16) is disposed in the boiler unit (11) so as to impose the load on the working fluid guide member (17), and the loading means (161) is configured by the bulkhead (16).

According to the above configuration, since the bulkhead (16) defining the evaporation chamber (156) and the fluid-pool chamber (157*a*) acts as the loading means, the structure of the heat engine can be simplified compared to the case where the bulkhead (16) and the loading means are separately provided.

The above embodiments provide, as another aspect,

[4-17] The heat engine according to [4-1], wherein the working fluid guide member (17) is formed of a material interwoven with resin fibers.

The above embodiments provide, as another aspect,

[4-18] A heat engine, comprising:

a boiler unit (41) which includes an evaporation chamber (411*b*) and a fluid-pool chamber (411*a*), the evaporation chamber (411*b*) heating a working fluid (44) by heat obtained from solar light and generating vapor, and the fluid-pool chamber (411*a*) collecting the working fluid (44) supplied to the evaporation chamber (411*b*);

an output unit (42) through which the vapor generated by the evaporation chamber (411*b*) flows, and which converts energy of the vapor to mechanical energy;

a condensation unit (43) which condenses the vapor that has passed through the output unit (42), and refluxes the condensed working fluid (44) to the fluid-pool chamber (411*a*); and a working fluid guide member (412) which is disposed in the boiler unit (41), and which sucks the working fluid (44) in the fluid-pool chamber (411*a*) by using capillary force and supplies the working fluid (44) to the evaporation chamber (411*b*), wherein the evaporation chamber (411*b*) is separated from the fluid-pool chamber (411*a*), pressure in the evaporation chamber (411*b*) being higher than pressure in the fluid-pool chamber (411*a*), the working fluid guide member (412) is configured to satisfy the following expression:

$$(2\sigma/r)\cdot\cos\theta > PH - PL$$

where σ is a surface tension of the working fluid (44), r is a circle-equivalent radius of a void in the working fluid guide member (412), θ is a wetting angle of the working fluid (44) with respect to the working fluid guide member (412), PH is pressure in the evaporation chamber (411*b*), and PL is pressure in the fluid-pool chamber (411*a*), the working fluid guide member (44) includes a suction portion (412*a*) which sucks the working fluid (44) of the fluid-pool chamber (411*a*) and a heat-reception portion (412*b*) which receives heat from the solar light, the working fluid guide member (44) has portions having voids of different successiveness, the portions having high successiveness of voids and the portions having low successiveness of voids alternately appearing from the side of the suction portion (412*a*) toward the side of the heat-reception portion (412*b*), the boiler unit (41) includes a solar light introducing portion (411*c*) which introduces the solar light into the evaporation chamber (411*b*), and the working fluid guide member (412) includes a heat-reception portion (412*b*) which receives the solar light introduced through the solar light introducing portion (411*b*) so as to be heated by the solar light.

According to the above configuration, in the heat engine in which mechanical energy is obtained from solar light, the working fluid (44) condensed in the condensation unit (43) can be circulated into the evaporation unit (411*b*) having a high pressure without using external energy as much as possible. Accordingly, energy can be saved and thus clean energy can be realized.

In addition, the working fluid guide member (44) has portions having voids of different successiveness, the portions having high successiveness of voids and the portions having low successiveness of voids alternately appearing from the side of the suction portion (412*a*) toward the side of the heat-reception portion (412*b*). Thus, the vapor can be suppressed from flowing back from the heat-reception portion (412*b*) to the suction portion (412*a*). Accordingly, the vapor can be properly sealed. In addition, suppliability of the working fluid (44) from the fluid-pool chamber (411*a*) to the evaporation chamber (411*b*) can be improved.

It will be appreciated that the present invention is not limited to the configurations described above, but any and all modifications, variations or equivalents, which may occur to those who are skilled in the art, should be considered to fall within the scope of the present invention.

What is claimed is:

1. A heat engine, comprising:

a boiler unit which includes an evaporation chamber and a fluid-pool chamber, the evaporation chamber heating a working fluid by heat supplied from an external heat source and generating vapor of the working fluid, and the fluid-pool chamber collecting the working fluid supplied to the evaporation chamber;

an output unit through which the vapor generated by the evaporation chamber flows, and which converts energy of the vapor to mechanical energy;

a condensation unit which condenses the vapor that has passed through the output unit, and refluxes the condensed working fluid to the fluid-pool chamber; and a working fluid guide member which is disposed in the boiler unit, and which sucks the working fluid in the fluid-pool chamber by using capillary force and supplies the working fluid to the evaporation chamber, wherein the evaporation chamber is separated from the fluid-pool chamber, pressure in the evaporation chamber being higher than pressure in the fluid-pool chamber, the working fluid guide member is configured to satisfy the following expression:

$$(2\sigma/r)\cdot\cos\theta > PH - PL.$$

where σ is a surface tension of the working fluid, r is a circle-equivalent radius of a void in the working fluid guide member, θ is a wetting angle of the working fluid with respect to the working fluid guide member, PH is pressure in the evaporation chamber, and PL is pressure in the fluid-pool chamber, the working fluid guide member includes a suction portion which sucks the working fluid of the fluid-pool chamber and a heat-reception portion which receives heat from the external heat source, the working fluid guide member has portions having voids of different successiveness, the voids of high successiveness extending from the side of the suction portion to the side of the heat-reception portion, and the working fluid guide member is located in a heat-transfer route starting from the external heat source to the fluid-pool chamber to suppress heat transfer from the external heat source to the fluid-pool chamber.

2. The heat engine according to claim 1, wherein the working fluid guide member has a laminated structure of a plurality of fiber layers, the plurality of fiber layers extend from the side of the suction portion toward the side of the heat-reception portion, and the portion having voids of high successiveness is an interface portion between the fiber layers.

3. The heat engine according to claim 2, wherein the working fluid guide member has a plate-like shape whose thickness direction is the direction in which the fiber layers extend, the suction portion is at one plate surface of the working fluid guide member, and the heat-reception portion is at the other plate surface of the working fluid guide member.

4. The heat engine according to claim 3, further comprising a flow port forming member which is disposed opposite the plate surface of the working fluid guide member on the side of the suction portion and forms a flow port that allows the working fluid to be sucked from the fluid-pool chamber to the suction portion, wherein the flow port is a groove cutting across the interface portion which is seen on the plate surface of the working fluid guide member on the side of the suction portion.

5. The heat engine according to claim 1, wherein the boiler unit includes a heat-transfer member which is in contact with the heat-reception portion of the working fluid guide member and transfers heat from the external heat source to the working fluid guide member, and a discharge path is formed in a portion of the heat-transfer member which is in contact with the heat-reception portion, the discharge path discharging the vapor generated by the working fluid guide member.

6. The heat engine according to claim 5, wherein the discharge path is a groove formed in the heat-transfer member.

7. The heat engine according to claim 5, wherein the heat-transfer member is divided into a discharge path forming member that forms the discharge path and a member that forms a remaining portion, the discharge path forming member is a mesh member or a plurality of ball-like members which are sandwiched between the member that forms the remaining portion and the working fluid guide member, and the discharge path is a gap formed by the mesh member or the plurality of ball-like members.

8. The heat engine according to claim 5, wherein the heat-transfer member has an upper portion extending in the horizontal direction, the working fluid guide member has a flat shape and overlaps with the upper portion of the heat-transfer member, and the working fluid guide member receives heat from the external heat source via the heat-transfer member.

9. The heat engine according to claim 8, wherein the boiler unit has a heat-transfer plate which overlaps with a surface of the working fluid guide member on the opposite side of the heat-transfer member and transfers heat from the external heat source to the working fluid guide member.

10. The heat engine according to claim 1, further comprising:

a boiler unit case which accommodates the boiler unit;

a reflux unit case which accommodates the output unit and the condensation unit;

a vapor path forming portion which forms a vapor path which allows communication between the evaporation chamber of the boiler unit and the output unit; and a circulation path forming portion which forms a circulation path which allows communication between the condensation unit and the fluid-pool chamber of the boiler unit, wherein the boiler unit case and the reflux unit case are disposed being distanced from each other while being connected via the vapor path forming portion and the circulation path forming portion.

11. The heat engine according to claim 8, wherein a through hole is formed in a portion of the working fluid guide member positioned inside the evaporation chamber, the through hole passing through the working fluid guide member.

12. The heat engine according to claim 11, wherein the through hole is in communication with the discharge path.

13. The heat engine according to claim 11, wherein the through hole is formed as a groove extending along a plate surface of the working fluid guide member.

14. The heat engine according to claim 11, wherein the through hole includes a plurality of scattered through holes.

15. The heat engine according to claim 1, wherein the boiler unit includes a loading means which impose a load on the working fluid guide member to reduce the size of the void in the working fluid guide member, and the working fluid guide member is held in the boiler unit in a state of being loaded by the loading means.

16. The heat engine according to claim 15, wherein the boiler unit includes a bulkhead which defines the evaporation chamber and the fluid-pool chamber, the bulkhead is disposed in the boiler unit so as to impose the load on the working fluid guide member, and the loading means is a part of the bulkhead.

17. The heat engine according to claim 1, wherein the working fluid guide member is formed of a material interwoven with resin fibers.

* * * * *